US005874206A

United States Patent [19]

Kimura et al.

[11] Patent Number: 5,874,206

[45] Date of Patent: Feb. 23, 1999

[54] SILVER HALIDE PHOTOGRAPHIC LIGHT SENSITIVE MATERIAL

[75] Inventors: Yoko Kimura; Taketoshi Yamada; Norio Miura, all of Hino, Japan

[73] Assignee: Konica Corporation, Japan

[21] Appl. No.: 825,113

[22] Filed: Mar. 27, 1997

[30] Foreign Application Priority Data

Apr. 1, 1996 [JP] Japan ..... 8-078692

[51] Int. Cl.[6] ..... G03C 1/40; G03C 1/035

[52] U.S. Cl. ..... 430/565; 430/364; 430/402; 430/542; 430/567; 430/569; 430/966

[58] Field of Search ..... 430/364, 402, 430/542, 565, 966, 567, 569

[56] References Cited

U.S. PATENT DOCUMENTS 4,818,675 4/1989 Miyasaka et al. .
5,561,038 10/1996 Goan ..... 435/567

FOREIGN PATENT DOCUMENTS 0616898 9/1994 European Pat. Off. .
0617320 9/1994 European Pat. Off. .
753888 2/1995 Japan .
876303 3/1996 Japan .

OTHER PUBLICATIONS

European Search Report EP 97 10 5312 and Annex (Jul. 1997).

*Primary Examiner*—Janis L. Dote
*Attorney, Agent, or Firm*—Jordan B. Bierman; Bierman, Muserlian and Lucas

[57] ABSTRACT

A silver halide photographic light sensitive material is disclosed, comprising a support having thereon a silver halide emulsion layer, wherein the silver halide emulsion layer contains tabular silver halide grains having an average iodide content of 1.0% or less; the silver halide emulsion layer further containing a dye compound represented by the following formula:

12 Claims, No Drawings

SILVER HALIDE PHOTOGRAPHIC LIGHT SENSITIVE MATERIAL

FIELD OF THE INVENTION

The present invention relates to a silver halide photographic material and in particular to a silver halide black-and-white photographic light sensitive material excellent in storage stability, which produces a blue black tone image.

BACKGROUND OF THE INVENTION

Recently, with regard to processing of a silver halide photographic light sensitive material (hereinafter, simply referred to as photographic material), shortening of processing time and curtailment of processing effluent have been demanded. In the field of medical use, the amount of X-ray photographing time is rapidly increasing due to increased use of X-rays for diagnosis and inspection in general medical examinations, as well as spread of periodical medical check-ups and clinical surveys. As a result, desire for still faster processing and reduction of processing effluent is raised.

Shortening of processing time including developing, fixing, washing, drying, etc. is the key for faster processing of photographic materials. Shortening of the developing time alone, however, leads to a marked decrease of image density and sensitivity and deterioration of contrast. Shortening of the fixing time alone leads to insufficient fixing, causing deterioration of image quality. Accordingly, it is basically required to enhance developability, fixability and dryability of a photographic material in concert.

It is conventionally believed that lowering the content of silver iodide with low solubility, the use of a silver chlorobromide or silver chloride emulsion with high solubility, the decrease of the silver halide grain size and the use of tabular-formed grains are advantageous for enhancement of developability and fixability. However, it is also known that lowering the silver iodide content and the use of a silver chlorobromide or silver chloride emulsion cause a decrease in sensitivity.

Techniques which incorporate silver halide solvents (thiocyanates) in a silver halide emulsion or a photographic material for the purpose of enhancement of sensitivity and developability are described in U.S. Pat. Nos. 2,222,264 and 3,320,069, and JP-A 62-18538 (the expression, "JP-A" means unexamined, published Japanese Patent Application). However, enhancement of the sensitivity by the use of the silver halide solvent leads to deterioration of storage stability, causing practical problems in use of the solvent.

It is known in the field of photographic printing papers that, as a method for sensitizing silver chloride grains, high sensitivity can be achieved by incorporating a compound of group VIII metal of the periodic table, within the grains. This effect concerns only cubic or octahedral grains, and effects concerning tabular grains are not known at this time.

For enhancement of developability to reduce processing effluent, it is desirable to use silver halide grains with high covering power whereby a high density can be obtained with a low silver coverage. The tabular grains are suitable therefore in terms of sensitivity, graininess, sharpness and spectral sensitization efficiency. On the other hand, as the size or thickness of silver halide grains decreases, scattering of blue light due to developed silver increases, resulting in strongly yellowish light to form an yellowish silver image.

With regard to techniques for modifying silver image tone, there have been reported a number of studies of photographic materials and processing. For example, specific mercapto compounds are well-known as a representative image toner. Recently, there has been proposed a technique in which a specific dye is dissolved in a water insoluble high boiling solvent, dispersed in water and incorporated in a photographic material, as described in JP-A 5-165147. However, it resulted in fluctuation in sensitivity, depending on the aging condition thereof before exposure. In X-ray photographic materials for medical use, there have been problems such as dirt adhering to the intensifying screen which is brought into contact with a photographic material at the time of exposure. Furthermore, in the above technique, since the same amount of dye as that of an exposed portion is contained in a non-exposed portion, there is the defect of increased fog density.

To overcome this defect, JP-A discloses a technique in which with forming a silver image, a dye image is formed, in response to the silver image, from a diffusion-proof compound capable of releasing a diffusible dye upon reaction with a silver ion, but the decreased effects of improving blackness of the silver image and lowering of the fog density were insufficient.

JP-A 3-153234 discloses a technique of using a leuco dye capable of forming a blue dye image in response to a silver image. Thereby, contamination of a developer and occurrence of stains can be minimized but since color tone of the blue dye formed from the leuco dye is in a longer wavelength region and has a greenish tint, the improvement in blackness of the silver image was insufficient. In addition, there was a defect such that leuco dye residue in a non-exposed portion of a processed photographic material is liable to color-form with aging, causing an increase of fog density.

SUMMARY OF THE INVENTION

Accordingly, it is a first object of the present invention to provide a silver halide photographic light sensitive material which is rapidly processable, with the resulting silver image color being neutral black or blue black tone. It is a second object of the invention to provide a silver halide photographic light sensitive material without contaminating a developer or staining the intensifying screen. It is a third object of the invention to provide a silver halide photographic light sensitive material with little variation of photographic performance due to aging.

The above objects of the invention can be accomplished by the following.

(1) A silver halide photographic light sensitive material comprising a support having thereon a silver halide emulsion layer, wherein said silver halide emulsion layer comprises tabular silver halide grains having an average iodide content of 1.0 mol % or less; said silver halide emulsion layer further comprising a compound represented by the following formula (1):

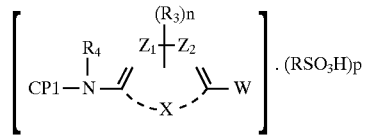

Formula (1)

In the formula, W is —$NR_1R_2$, —OH or —OZ, in which $R_1$ and $R_2$ each are an alkyl group or an aryl group and Z is an alkali metal ion or a quaternary ammonium ion. $R_3$ is a hydrogen atom, a halogen atom or a univalent substituent and n is an integer of 1 to 3. $Z_1$ and $Z_2$ each are a nitrogen atom or $=C(R_3)-$. X is an atomic group necessary for forming a 5- or 6-membered aromatic heterocyclic ring with $Z_1$, $Z_2$ and carbon atoms adjoining thereto. $R_4$ is a hydrogen atom, an acyl group, a sulfonyl group, carbamoyl group, sulfo group, sulfamoyl group, an alkoxycarbonyl group, or aryoxycarbonyl group. R is an aliphatic group or an aromatic group. p is an integer of 1 or 2. CP1 is the following groups:

CP1

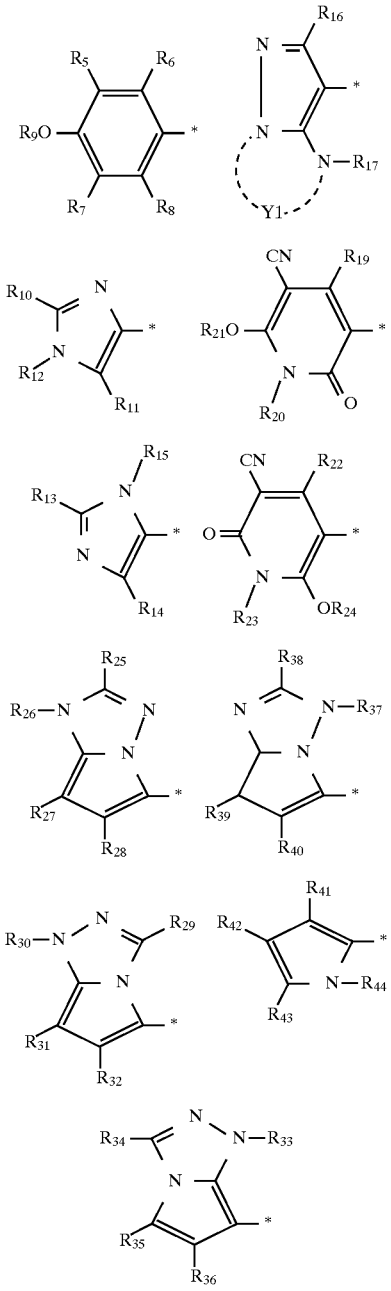

In the formula, $R_5$ through $R_8$ each are a hydrogen atom, a halogen atom or a substituent for a benzene ring, provided that $R_5$ and $R_6$, or $R_7$ and $R_8$ may be linked with each other to form a 5 to 7-membered ring. $R_9$ has the same definition as $R_4$. $R_{10}$ and $R_{11}$ each are an alkyl group, an aryl group or a heterocyclic group. $R_{12}$ has the same definition as $R_4$. $R_{13}$ and $R_{14}$ each have the same definition of $R_{10}$ and $R_{11}$. $R_{15}$ has the same definition as $R_{12}$. $R_{16}$ is an alkyl group, an aryl group, a sulfonyl group, a trifluoromethyl group, a carboxy group, an aryloxycarbonyl group, an alkoxycarbonyl group, a carbamoyl group or a cyano group. $R_{17}$ has the same definition as $R_4$. $R_{18}$ has the same definition as $R_3$ and m is an integer of 1 to 3. $Y_1$ is an atomic group necessary for forming 5- or 6-membered nitrogen containing monocyclic or condensed ring together with two nitrogen atoms. $R_{19}$ and $R_{20}$ each are an alkyl group or an aryl group. $R_{21}$ has the same definition as $R_4$. $R_{22}$ and $R_{23}$ each have the same definition as $R_{19}$ and $R_{20}$. $R_{24}$ has the same definition as $R_{21}$. $R_{25}$, $R_{27}$ and $R_{28}$ each are a hydrogen atom or a substituent. $R_{26}$ has the same definition as $R_4$. $R_{29}$, $R_{31}$ and $R_{32}$ each have the same definition as $R_{25}$, $R_{27}$ and $R_{28}$. $R_{30}$ has the same definition as $R_{26}$. $R_{34}$, $R_{35}$ and $R_{36}$ each have the same definition $R_{25}$, $R_{27}$ and $R_{28}$. $R_{33}$ has the same definition as $R_{26}$. $R_{38}$, $R_{39}$ and $R_{40}$ each have the same definition as $R_{25}$, $R_{27}$ and $R_{28}$. $R_{37}$ has the same definition as $R_{26}$. $R_{41}$, $R_{42}$ and $R_{43}$ each have the same definition as $R_{25}$, $R_{27}$ and $R_{28}$. $R_{44}$ has the same definition as $R_{26}$. The symbol, "★" represents a bonding site of CP1 with the other moiety.

(2) The silver halide photographic light sensitive material described in above (1), characterized in that said compound represented by formula (1) is represented by the following formula (2):

Formula (2)

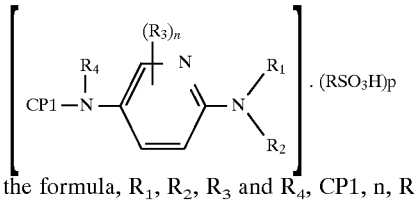

In the formula, $R_1$, $R_2$, $R_3$ and $R_4$, CP1, n, R and p each have the same definitions as those of $R_1$, $R_2$, $R_3$ and $R_4$, CP1, n, R and p in formula (1).

(3) A silver halide photographic light sensitive material, characterized in that said photographic material contains a compound represented by the following formula (3) and a compound represented by $RSO_3H$:

Formula (3)

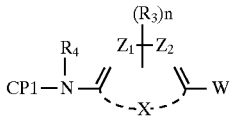

In the formula, $R_3$, n. $R_4$, W, X, $Z_1$, $Z_2$ and CP1 each have the same definitions as those of $R_3$, n. $R_4$, W, X, $Z_1$, $Z_2$ and CP1 in the above (1), respectively.

(4) The silver halide photographic light sensitive material described in (3), characterized in that said compound represented by formula (3) is represented by formula (4):

Formula (4)

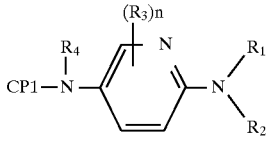

In the formula, $R_1$, $R_2$, $R_3$, $R_4$, CP1 and n each have the same definition as those of $R_1$, $R_2$, $R_3$, $R_4$, CP1and n in formula (1), respectively.

(5) The silver halide photographic light sensitive material described in above (1) through (4), characterized in that, in the compound represented by formula (1) through (4), at least one of $R_4$, $R_9$, $R_{12}$, $R_{15}$, $R_{17}$, $R_{21}$, $R_{24}$, $R_{26}$, $R_{30}$, $R_{33}$, $R_{37}$ and $R_{44}$ is substituted by at least one selected from the group consisting of $-COOM^1$ and $-SO_3M^2$, in which $M^1$ and $M^2$ each are a hydrogen atom or an alkali metal atom.

(6) The silver halide photographic light sensitive material described in above (1), characterized in that said tabular grains have an aspect ratio of 2 to 20 and account for at least 50% of the total grain projected area of silver halide grains contained in said silver halide emulsion layer, said tabular grains having been formed in the presence of a silver halide solvent.

(7) The silver halide photographic light sensitive material described in (6), wherein silver iodide of 1.0 mol % or less is allowed to contain within silver halide grains during the course of forming silver halide grains.

(8) The silver halide photographic light sensitive material described in (1), wherein said tabular grains have (100) major faces, an aspect ratio of 1.3 or more and a chloride content of 20 mol % or more, and account for at least 50% of the total projected area of silver halide grains contained in said silver halide emulsion layer, said silver halide grains containing at least a metal selected from the group consisting of metals of VIII group of the periodic table, transition metals of II group of the periodic table, lead, rhenium, molybdenum, chromium, and a compound represented by formula (1) described above being contained.

DETAILED DESCRIPTION OF THE INVENTION

The tabular silver halide grains according to the invention comprise silver iodobromide, silver bromide, silver iodochloride, silver chlorobromide or silver iodochlorobromide. Among these silver halides are preferred silver iodobromide, silver iodochloride or silver iodochlorobromide. In the case of silver iodobromide, the average overall iodide content is 1.0 mol % or less and preferably, 0.5 mol % or less.

As a method for forming an iodide phase according to the invention, a method in which an aqueous solution of a silver salt, such as silver nitrate, and an iodide ion containing aqueous solution were simultaneously added into an emulsion containing tabular grains as substrate, a method in which silver halide fine grains such as silver iodide, silver iodobromide or silver iodochlorobromide and a method in which potassium iodide or a mixture of potassium iodide and potassium bromide is added are applicable. Among these, the method in which silver halide fine grains are added are preferred. An addition of silver iodide fine grains is particularly preferred.

In the silver halide tabular grains according to the invention, the iodide may be contained in any portion of the grain. The iodide is preferably contained in the outermost surface of the grain. Thus, the iodide is incorporated in the grains during a period of from the time of completion of grain growth to the time of completion of chemical ripening.

The iodide content of each grain and an average iodide content of overall grains can be determined by means of EPMA (Electron Probe Micro Analyzer). In this method, a sample which is prepared by dispersing silver halide grains so as not to be contact with each other, is exposed to an electron beam to conduct X-ray analysis by excitation with the electron beam. Thereby, elemental analysis of a minute portion can be done. Thus, halide composition of each grain can be determined by measuring intensities of characteristic X-ray emitted from each grain with respect to silver and iodide. At least 50 grains are subjected to the EPMA analysis to determine their iodide contents, from which the average iodide content can be determined.

It is preferred that the silver halide tabular grains according to the invention have uniformly iodide contents among grains. When the iodide content of grains is determined by the EPMA analysis, a relative standard deviation thereof (i.e., a variation coefficient of the iodide content of grains) is 35% or less, preferably, 20% or less.

The tabular silver halide grains according to the invention account for 50% or more of the grain projected area of the total grains contained in a silver halide emulsion layer of a photographic material, and having an average aspect ratio (grain diameter/grain thickness) of 2 to 20, preferably 2 to 12 and more preferably, 3 to 8. The grain diameter is its equivalent circular diameter (i.e., the diameter of a circle having an area equivalent to the projected area of the grain). The grain thickness is referred to as a distance between two parallel major faces.

The tabular silver halide grains are preferably monodispersed. In other words, a width of grain size distribution is preferably 25% or less, further preferably, 20% or less and furthermore preferably, 15% or less. The width of the grain size distribution is defined in a relative standard deviation (variation coefficient) of the grain diameter, which is expressed as;

$$\text{width of grain size distribution (\%)} = (\text{standard deviation of grain diameter/average grain diameter}) \times 100.$$

The tabular silver halide grains are preferably small in grain thickness distribution. In other words, a width of grain thickness distribution is preferably 25% or less, further preferably, 20% or less and furthermore preferably, 15% or less. The width of the grain thickness distribution is defined in a relative standard deviation (variation coefficient) of the grain thickness, which is expressed as;

$$\text{width of grain thickness distribution (\%)} = (\text{standard deviation of grain thickness/average grain thickness}) \times 100.$$

The tabular silver halide grains is preferably hexagonal. The hexagonal tabular silver halide grains (hereinafter, sometimes, referred to as hexagonal tabular grains) have hexagonal major faces ((111) faces), and having a maximum adjacent edge ratio of 1.0 to 2.0. The expression, "maximum adjacent edge ratio" is referred to as a ratio of a maximum length of edges constituting the hexagon to a minimum edge length.

In the invention, if the hexagonal tabular silver halide grains have a maximum adjacent edge ratio of 1.0 to 2.0, the corner of the grain may be roundish. In the case of being roundish, the edge length is defined as a distance between crossing points of an extended straight line of the edge and that of an adjacent edge. The corner may disappear, resulting in round grains. It is preferred that ½ or more of each edge of the hexagonal tabular grains is substantially straight. The a maximum adjacent edge ration is preferably 1.0 to 1.5.

The silver halide solvent used in the invention includes (a) organic thioethers, (b) thiourea derivatives, (c) silver halide solvent compounds having a thiocarbonyl group adjoined to an oxygen or sulfur atom and a nitrogen atom, (d) imidazoles, (e) sulfites and (f) thiocyanates. In addition thereto, silver halide solvents described in JP-A 57-196228 may be usable. Exemples of the above compounds are shown as below.

(a)

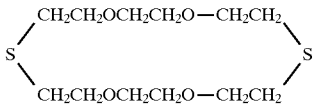

$HOCH_2CH_2SCH_2CH_2SCH_2CH_2OH$
$HOOCCH_2CH_2CONHCH_2CH_2SCH_2CH_2SC_2H_5$ (b)

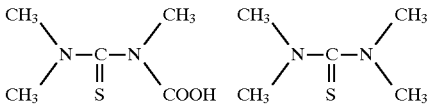

(c)

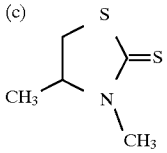

(d)

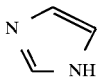

(e)

$K_2SO_3$ (f)

$NH_4SCN$
KSCN

Among the solvents, a thiocyanate and tetramethylthiourea are preferred. The thiocyanate includes a thiocyanate metal salt or ammonium thiocyanate. In the case of the metal salt, a metal which has no disadvantageous effect on photographic performance is preferred and a potassium or sodium salt is more preferred. A scarcely water-soluble salt such as silver thiocyanate may be added in the form of a fine particle dispersion. The silver halide solvent may be added at any time during the course of preparing silver halide grains. It is preferably added prior to desalting. Addition amounts depend on the kind of the solvent. A thiocyanate, for example, is added during the course of grain formation to completion of chemical ripening, in a total amount of not less than $2.5\times10^{-3}$ to less than $5\times10^{-2}$ mol per mol of silver halide. The tabular silver halide grains contain 1.0 mol % or less, preferably, 0.5 mol % or less and more preferably, 0.4 mol % or less iodide. The iodide is formed in the presence of a silver halide solvent. It is preferred that 0.4 mol % or less of iodide is formed, in the presence of a silver halide solvent, prior to a desalting step and 0.6 mol % or less of iodide is formed, in the presence of a silver halide solvent, during chemical ripening.

In the invention, in cases when using tabular silver halide grains having (100) major faces, the major faces is in the form of a right-angled parallelogram or one having round corner(s). An adjacent edge ratio of the right-angled parallelogram is less than 10, preferably, less than 5 and more preferably, less than 2. In the case of the corner being roundish, the edge length is defined as a distance between crossing points of an extended straight line of the edge and that of an adjacent edge. The corner may disappear, resulting in round grains. The tabular silver halide grains may contains chloride in an amount of 20 mol % or more and preferably, 30 to 70 mol % chloride. The iodide content is 1.0 mol % or less and preferably, 0.5 mol % or less.

The tabular silver halide grains may contain dislocation. The dislocation can be directly observed by using a transmission electron microscope at a low temperature, as described in J. F. Hamilton, Phot. Sci. Eng., 57 (1967) and Shiozawa, J. Soc. Phot. Sci. Japan, 35, 213 (1972). Thus, silver halide grains which are taken out from an emulsion without applying pressure in an extent of causing dislocation within the grain, are placed on a mesh for use in electron-microscopic observation and observed by a transmission electron microscope under cooling conditions for preventing damage due to the electron beam (e.g., print-out). In view of the fact that the thicker the grain is, the harder transmission of the electron beam becomes, the use of a high voltage type (i.e., 200 kV or more per 0.25 $\mu$m in grain thickness) electron microscope is preferred for definite observation.

During the course of forming silver halide grains used in the invention, silver nuclei may be formed. The silver nuclei can be formed by adding a reducing agent to an emulsion or a mixing solution used for grain growth; or by causing grains to grow or ripen at a low pAg of 7 or less or a high pH of 7 or more. A combination these methods is a preferred embodiment of the invention.

As a technique for forming silver nuclei, reduction sensitization has been known, as described in J. Phot. Sci. 25, 19–27 pages (1977) and Phot. Sci. Eng. 32, 113–117 pages (1979). As described by Michell and Lowe in Photo. Korr. Vol 1, 20 (1957) and Phot. Sci. Eng. 19, 49–55 (1975), it has been considered that silver nuclei formed through reduction sensitization contribute sensitization through the following reaction on exposure:

$$AgX+h\nu\rightarrow e^-+h^+ \quad (1)$$

$$Ag_2+h^+\rightarrow Ag^++Ag \quad (2)$$

$$Ag\rightarrow Ag^+e^- \quad (3)$$

wherein $h^+$ and $e^-$ represent a free hole and a free electron produced upon exposure, hv represents a photon and $Ag_2$ represents a silver nucleus formed through reduction sensitization.

Preferred reducing agents include thiourea dioxide, ascorbic acid and its derivative, and a stannous salt. In addition, borane compounds, hydrazine derivatives, formamidinesulfinic acid, silane compounds, amines or polyamines, and sulfites are also appropriate reducing agents. The reducing agent is added in an amount of $10^{-2}$ to $10^{-8}$ mol per mol of silver halide.

To carry out ripening at a low pAg, there may be added a silver salt, preferably aqueous soluble silver salt. As the aqueous silver salt is preferably silver nitrate. The pAg in the ripening is 7 or less, preferably 6 or less and more preferably 1 to 3 (herein, $pAg=-\log[Ag^+]$).

Ripening at a high pH is conducted by adding an alkaline compound to a silver halide emulsion or mixture solution for growing grains. As the alkaline compound are usable sodium hydroxide, potassium hydroxide, sodium carbonate, potassium carbonate and ammonia. In a method in which ammoniacal silver nitrate is added for forming silver halide, an alkaline compound other than ammonia is preferably employed because of lowering an effect of ammonia.

The silver salt or alkaline compound may be added instantaneously or over a period of a given time. In this case, it may be added at a constant rate or accelerated rate. It may be added dividedly in a necessary amount. It may be made present in a reaction vessel prior to the addition of aqueous-soluble silver salt and/or aqueous-soluble halide, or it may be added to an aqueous halide solution to be added. It may be added apart from the aqueous-soluble silver salt and halide.

In the invention, a oxidizing agent may be used for the silver halide emulsion. The following oxidizing agents may be used.

Hydrogen peroxide and its adduct (e.g., $NaBO_2$—$H_2O_2$-$3H_2O$, $2NaCO_3$-$3H_2O_2$, $Na_4P_2O_7$-$2H_2O_2$, $2Na_2SO_4$—$H_2O_2$—$H_2O$), peroxy acid salt (e.g., $K_2S_2O_8$, $k_2C_2O_6$, $K_4P_2O_8$), $K_2[Ti(O_2)C_2O_4]3H_2O$ are cited. In addition, peracetic acid, ozone, iodine, bromine and thiosulfonic acid type compound are also usable.

The addition amount of the oxidizing agent depends on kind of a reducing agent, conditions for forming silver nuclei, addition time and conditions of the oxidizing agent, and is preferably $10^{-2}$ to $10^{-5}$ mol per mol of silver halide.

The oxidizing agent may be added at any step during the course of preparing silver halide emulsion The oxidizing agent may be added prior to addition of the reducing agent. After adding the oxidizing agent, a reducing agent may newly added to deactivate a oxidizing agent in excess. The reducing agent, which is capable of oxidizing the above oxidizing agent, includes sulfinic acids, di- or tri-hydroxybenzenes, chromanes, hydrazines or hydrazides, p-phenylenediamines, aldehydes, aminophenols, ene-diols, oximes, reducing sugars, phenidones, sulfites and ascorbic acid derivatives. The reducing agent is added in an amount of $10^{-3}$ to $10^{3}$ mol per mol of silver halide.

Heavy metal ions usable in the invention are preferably Group VIII metal elements of the periodic table, such as iron, iridium, platinum, palladium, nickel, rhodium, osmium, ruthenium and cobalt; Group II metal elements, such as cadmium, zinc and mercury; lead, molybdenum, tungsten, chromium. Among these, transition metal ions, such as iron, iridium, platinum, ruthenium and osmium are preferred.

The heavy metal ion may be to a silver halide emulsion in the form of a salt or a complex salt. In particular, addition in the form of a complex salt is preferred, since it is easily incorporated in the grain, resulting in larger effects.

In cases where the heavy metal ion forms a complex, examples of ligands include a cyanide, thiocyanate, isothiocyanate, cyanate, chloride, bromide, iodide, carbonyl, and ammonia. Among these, thiocyanate, isothiocyanate and cyanate are preferred.

Heavy metal compounds usable in the invention are shown as below, but not limited to these compounds.

(1) $FeCl_2$, (2) $FeCl_3$, (3) $(NH_4)Fe(SO_4)_2$, (4) $K_3[Fe(CN)_6]$, (5) $K_4[Fe(CN)_6]$, (6) $K_2[IrCl_6]$, (7) $K_3[IrCl_6]$, (8) $K_2[PtCl_6]$, (9) $K_2[Pt(SCN)_4]$, (10) $K_2[NiCl_4]$, (11) $K_2[PdCl_6]$, (12) $K_3[PdCl_6]$, (13) $CdCl_2$, (14) $ZnCl_2$, (15) $K_2[Mo(CO)_4(CN0)_2]$, (16) $K_3[Re(CNO)_6]$, (17) $K_3[Mo(CNO)_6]$, $K_4[Fe(CN0)_6]$, (19) $K_2[W(CO)_4(CNO)_2]$, (20) $K_2[Cr(CO)_4(CNO)_2]$, (21) $K_4[Ru(CNO)_6]$, (22) $K_2[Ni(CN)_4]$, (23) PbCl2, (24) $K_3[Co(NH_3)_6]$, (25) $K_5[Co(CNO)_{11}]$, (26) $K_3[Re(CNO)_6]$, (27) $K_4[Os(CNO)_6]$, (28) $K_2[Cd(CNO)_4]$, (29) $K_2[Pt(CNO)_4]$, (30) $K_3[IrBr_6]$

The heavy metal ion may be contained in silver halide emulsion grains by adding a heavy metal compound at a time before, during ,or after forming silver halide grains and during physical ripening. For example, the heavy metal compound is added, in the form of a aqueous solution, at a desired timing. It may be contained in silver halide, and the resulting silver halide is continuously added over a period of forming silver halide grains. The heavy metal is added in an amount of $1\times10^{-9}$ to $1\times10^{-2}$ and preferably, $1\times10_{-8}$ to $1\times10_{-3}$ mol per mol of silver halide.

The average grain diameter of the tabular silver halide grains according to the invention is preferably 0.2 to 3.0 $\mu$m and more preferably 0.4 to 2.0 $\mu$m. The average grain thickness is preferably 0.02 to 1.0 $\mu$m, more preferably 0.05 to 0.40 $\mu$m and most preferably 0.05 to 0.30 $\mu$m. The grain diameter and thickness can be optimized so as to make best the sensitivity and pressure properties.

Gelatin is preferably employed as a dispersing medium used for protective colloid of silver halide grains. Usable gelatins include alkali-processed gelatin, acid-processed gelatin, low molecular weight gelatin (molecular weight of 20,000 to 100,000), modified gelatin such as phthalated gelatin. In addition, hydrophilic colloid is also usable, as concretely described in Research Disclosure (hereinafter, denoted as RD) Vol. 176, 17643 (Dec., 1978).

Silver halide emulsions may be subjected to desalting to remove unnecessary soluble salts or may be left contained. Desalting can be carried out according to methods described in RD Vol.176, 17643, II.

The tabular silver halide grains can be chemically sensitized. Conditions for chemical ripening, i.e., chemical sensitizing process, such as pH, pAg, temperature, and time are not specifically limitative. Chemical ripening can be conducted according to conditions used in the art.

Chemical sensitization is conducted by employing sulfur sensitization with a compound containing sulfur capable of reacting with a silver ion or active gelatin, selenium sensitization with selenium compounds, tellurium sensitization with tellurium, reduction sensitization with reducing compounds and noble metal sensitization with noble metals such as gold, singly or in combination thereof. Among these, selenium sensitization, tellurium sensitization and reduction sensitization are preferably employed. Specifically, the selenium sensitization is preferred.

Selenium sensitizers usable in the selenium sensitization include a variety of selenium compounds. Examples thereof include colloidal selenium metal, isoselenocyanates (e.g., allylisoselenocyanate), selenoureas (e.g., N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea), selenoketones (e.g., selenoacetone, selenoacetophenone), selenoamides (selenoacetoamide N,N-dimethylselenobenzamide), selenocarboxylic acids and selenoesters (e.g., 2-selenopropionic acid, methyl-3-selenobutylate), selenophosphates (tri-p-triselenophosphate), and selenides (e.g., triphenylphosphineselenide, diethylselenide, diethyldiselenide). Among these sensitizers, selenoureas, selenoamides, selenoketones and selenides are preferred.

The using amount of the selenium sensitizer depends on a selenium compound, silver halide grains or chemical sensitizing conditions, and is generally within a range of $10^{-8}$ to $10^{-4}$ mol per mol of silver halide. The selenium sensitizer may be added through solution in water or organic solvents such as methanol and ethanol, through mixing with a gelatin solution, or in the form of a emulsifying dispersion of a mixture with an organic solvent-soluble polymer, as described in JP-A 4-140739.

Chemical ripening with the selenium sensitizer is conducted at a temperature of 40° to 90° C. and preferably 45° to 80° C. The pH and pAg are preferably 4 to 9 and 6 to 9.5, respectively.

Examples of usable tellurium sensitizers include tellurureas (e.g., N,N-dimethyltellurourea, tetramethyltellurourea, N-carboxyethyl-N,N'-dimethyltellurourea, N,N'-dimethyl-N'-phenyltellurourea), phosphinetelurides (e.g., tributylphosphineteluride, tricyclohexylphosphineteluride, triisopropylphosphineteluride, butyl-di-isopropylphosphineteluride, dibutylphenylphosphineteluride), telluroamides (telluroacetoamide, N,N-dimethyltellurobenzamide), telluroketones, telluroesters and isotellurocyanates.

The tellurium sensitizer is employed in a manner similar to the selenium sensitizer.

It is preferred that silver halide grain surface is reduction-sensitized by exposing to reducible environment. Examples of preferred reducing agents include thiourea dioxide, and ascorbic acid and derivatives thereof. Other ones are hydrazines, polyamines such as diethyltriamine, dimethylamineboranes and sulfites.

The addition amount of the reducing agent depends on kind of the reducing agent, the grain size, composition and crystal habit of silver halide grains, and environmental conditions such as temperature, pH or pAg of reaction system. Thiourea dioxide, for example, is added in an amount of 0.01 to 2 mg per mol of silver halide to obtain preferred results. Ascorbic acid is preferably added in an amount of 50 mg to 2 g per mol of silver halide.

As to conditions for the reduction sensitization, the temperature is preferably 40° to 70° C.; the time, 10 to 200 min.; the pH, 5 to 11; the pAg, 1 to 10.

Reduction sensitization by adding a water-soluble silver salt, so-called silver ripening is conducted. Silver nitrate is preferably used as the water soluble silver salt. The silver ripening is conducted at a pAg of 1 to 6 and preferably 2 to 4. The conditions thereof, such as the temperature, pH and time are similar to those of the reduction sensitization described above.

As a stabilizer for a silver halide emulsion containing reduction-sensitized silver halide grains are usable generally used stabilizers, as described below. Specifically, excellent results can be achieved by use of antioxidants described in JP-A 57-82831 and/or thiosulfonates described in V. S. Gahler, Zeitshrift fur wissenschaftliche Photographie, Bd.63, 133 (1969) and JP-A 54-1019. These compounds may be added at any time during the course of emulsion preparation from grain growth to the step immediately before coating.

In formulas (1) through (4), an alkyl group represented by $R_1$ and $R_2$ preferably includes a methyl group, ethyl group, propyl group and butyl group, which may be substituted. Preferred examples of the substituent include hydroxy group and sulfonamido group.

An aryl group represented by $R_1$ and $R_2$ preferably includes a phenyl group.

The univalent substituent represented by $R_3$ includes an alkyl group (e.g., methyl, ethyl, isopropyl, hydroxyethyl, methoxyethyl, trifluoromethyl, t-butyl, etc.), cycloalkyl group (e.g., cyclopentyl, cyclohexyl, etc.), aralkyl group (e.g., benzyl, 2-phenethyl, etc.), aryl group (e.g., phenyl, naphthyl, p-tolyl, p-chlorophenyl, etc.), alkoxy group (e.g., methoxy, ethoxy, isopropoxy, n-butoxy, etc.), aryloxy group (e.g., phenoxy, etc.), cyano group, acylamino group (e.g., acetylamino, propionylamino, etc.), alkylthio group (e.g., methylthio, ethylthio, n-butylthio, etc.), arylthio group (e.g., phenylthio etc.), sulfonylamino group (e.g., methanesulfonylamino, benzenesulfonylamino, etc.), ureido group (e.g., 3-methylureido, 3,3-dimethylureido, 1,3-dimethylureido, etc.), sulfamoylamino group (e.g., dimethylsulfamoylamino, etc.), carbamoyl group (e.g., methylcarbamoyl, ethylcarbamoyl, dimethylcarbamoyl, etc.), sulfamoyl group (e.g., ethylsulfamoyl, dimethylsulfamoyl, etc.), alkoxycarbonyl group (e.g., methoxycarbonyl, ethoxycarbonyl, etc.), aryloxycarbonyl group (e.g., pheoxycarbonyl, etc.), sulfonyl group (e.g., methanesulfonyl, butanesulfonyl, phenylsulfonyl, etc.), acyl group (e.g., acetyl, propanoyl, butyloyl, etc.), amino group (e.g., methylamino, ethylamino, dimethylamino, etc.), hydroxy group, nitro group, imido group (e.g., phthalimido, etc.), and heterocyclic group (e.g., pyridyl, benzimidazolyl, benzthiazolyl, benzoxazolyl, etc.).

Regarding $R_4$, the acyl group preferably includes an acetyl group, trifluoroacetyl group and benzoyl group. The sulfonyl group preferably includes a methanesulfonyl group and benzenesulfonyl group. The carbamoyl group preferably includes a diethylcarbamoyl group and phenyl carbamoyl group. The sulfamoyl group preferably includes a diethylsulfamoyl group. The alkoxycarbonyl group preferably includes a methoxycarbonyl group and ethoxycarbonyl group. The aryoxycarbonyl group preferably includes a phenoxycarbonyl group.

Regarding Z, the alkali metal includes sodium and potassium. The quaternary ammonium is an ammonium having a total carbon atoms of 8 or less, including trimethylbenzylammonium, tetrabutylammonium and tetradecylammonium.

Examples of the 5- or 6-membered aromatic heterocyclic ring formed with X, Z1, $Z_2$ and carbon atoms adjoining thereto include a pyridine ring, pyridazine ring, pyrazine ring, triazine ring, tetrazine ring, pyrrol ring, furan ring, thiophene ring, thiazole ring, oxazole ring, imidazole ring, thiadiazole ring, and oxadiazole ring. Among these, the pyridine ring is preferred.

As the substituents for a benzene ring represented by $R_5$ through $R_8$ are cited the same as those of the univalent substituent represented by $R_3$. Among these are preferred an alkyl group and acylamino group. The 5- to 7-membered ring formed by a combination of $R_5$ and $R_6$, or $R_7$ and $R_8$ includes an aromatic hydrocarbon ring and heterocyclic ring, preferably, benzene ring.

Regarding $R_{10}$ and $R_{11}$, examples of the alkyl group include methyl, ethyl, propyl and butyl. Examples of the aryl group include a phenyl group and naphthyl group. As the heterocyclic group is cited an aromatic heterocyclic ring containing at least one of O, S and N (e.g., 6-membered azine ring, such as pyridine, pyrazine and pyrimidine, and its benzelogue; pyrrol, thiophene and furan, and their benzelogue; 5-membered azole ring, such as imidazole, pyrazole, triazole, tetrazole, thiazole, oxazole, thiadiazole and oxadiazole, and its benzelogue. $R_{10}$ and $R_{11}$ are preferably a phenyl group, pyrazolyl group and pyridyl group.

Regarding $R_{16}$, examples of the alkyl group include a methyl group, isopropyl group, pentyl group and t-butyl group. The aryl group includes a phenyl group, naphthyl group and so forth. The sulfonyl group includes a methanesulfonyl group, benzenesulfonyl group and so forth. The aryloxycarbonyl group includes a phenoxycarbonyl group and so forth. The alkoxycarbonyl group includes an ethoxycarbonyl group and so forth. The carbamoyl group includes a diethylaminocarbamoyl group and so forth.

Examples of the nitrogen-containing heterocyclic ring represented by Y1 include imidazole, triazole and tetrazole rings and their benzo-condensed rings.

Regarding $R_{19}$ and $R_{20}$, examples of the alkyl group include a methyl group, pentyl group, t-butyl group and so forth. examples of the aryl group include a phenyl group, naphthyl group and so forth.

The substituent represented by $R_{25}$, $R_{27}$ or $R_{28}$ includes a phenyl group, methyl group, benzoyl group, phenoxy group, ethoxy group and so forth.

Examples of the aliphatic group represented by R include a hexyl group, dodecyl group and so forth. The aromatic group includes p-toluene, dodecylbenzene, and so forth.

Exemplary Examples of the compounds represented formulas (1) through (4) are shown as below, but the invention is not limited thereto.

| No. | CP1 | CD | $RSO_3H$ | No. | CP1 | CD | $RSO_3H$ |
|---|---|---|---|---|---|---|---|
| 1 | 1 | 1 | | 40 | 26 | 15 | |
| 2 | 1 | 2 | | 41 | 26 | 19 | |
| 3 | 1 | 3 | | 42 | 33 | 2 | |
| 4 | 1 | 4 | | 43 | 33 | 10 | |
| 5 | 1 | 5 | | 44 | 33 | 14 | |
| 6 | 1 | 6 | | 45 | 33 | 16 | |
| 7 | 1 | 7 | | 46 | 34 | 2 | |
| 8 | 1 | 8 | | 47 | 34 | 5 | |
| 9 | 1 | 9 | | 48 | 35 | 17 | |
| 10 | 1 | 10 | | 49 | 35 | 21 | |
| 11 | 1 | 21 | | 50 | 36 | 3 | |
| 12 | 1 | 25 | | 51 | 37 | 1 | |
| 13 | 2 | 2 | | 52 | 37 | 4 | |
| 14 | 2 | 7 | | 53 | 38 | 30 | |
| 15 | 2 | 15 | | 54 | 40 | 2 | |
| 16 | 2 | 20 | | 55 | 42 | 8 | |
| 17 | 3 | 1 | | 56 | 1 | 1 | b |
| 18 | 3 | 2 | | 57 | 1 | 4 | a |
| 19 | 3 | 8 | | 58 | 1 | 8 | c |
| 20 | 4 | 16 | | 59 | 1 | 8 | a |
| 21 | 4 | 22 | | 60 | 1 | 9 | b |
| 22 | 5 | 1 | | 61 | 2 | 13 | a |

-continued

| No. | CP1 | CD | $RSO_3H$ | No. | CP1 | CD | $RSO_3H$ |
|---|---|---|---|---|---|---|---|
| 23 | 5 | 7 | | 62 | 2 | 19 | c |
| 24 | 5 | 11 | | 63 | 11 | 1 | b |
| 25 | 5 | 27 | | 64 | 17 | 9 | d |
| 26 | 7 | 1 | | 65 | 20 | 24 | a |
| 27 | 7 | 2 | | 66 | 23 | 4 | e |
| 28 | 8 | 9 | | 67 | 26 | 28 | c |
| 29 | 8 | 12 | | 68 | 33 | 8 | b |
| 30 | 16 | 2 | | 69 | 36 | 3 | a |
| 31 | 16 | 7 | | 70 | 39 | 2 | c |
| 32 | 17 | 10 | | 71 | 41 | 1 | e |
| 33 | 18 | 13 | | 72 | 41 | 4 | b |
| 34 | 21 | 1 | | 73 | 42 | 28 | a |
| 35 | 21 | 4 | | 74 | 43 | 8 | |
| 36 | 21 | 7 | | 75 | 43 | 9 | |
| 37 | 21 | 18 | | 76 | 43 | 4 | a |
| 38 | 26 | 2 | | 77 | 44 | 8 | |
| 39 | 26 | 7 | | 78 | 44 | 9 | |
| | | | | 79 | 44 | 4 | a |

In the above, CD represents

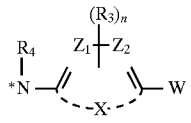

CP1

CP-1

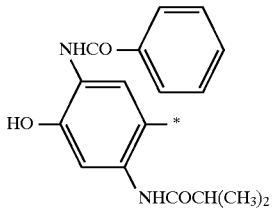

CP-2

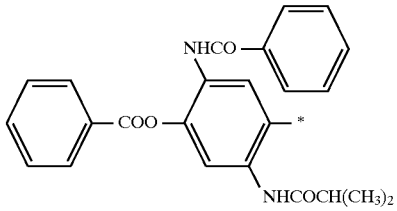

CP-3

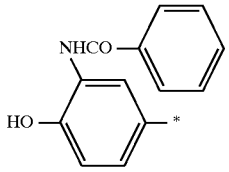

CP-4

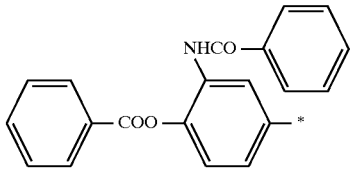

-continued
CP-5
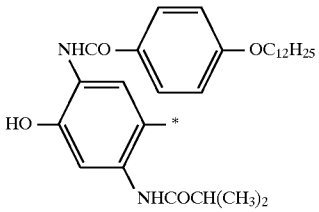
CP-6
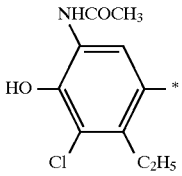
CP-7
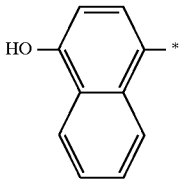
CP-8
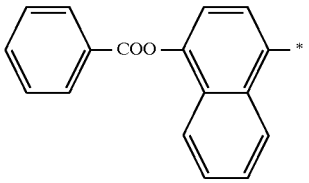
CP-9
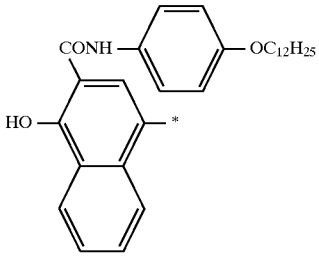
CP-10
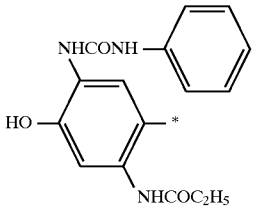
CP-11
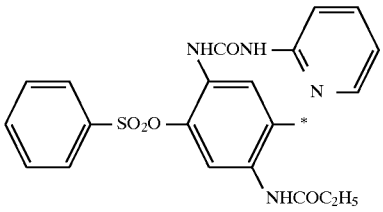

-continued
CP-12
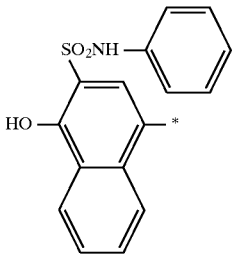
CP-13
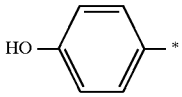
CP-14
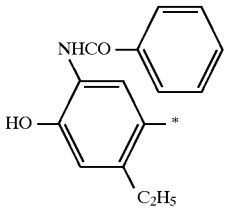
CP-15
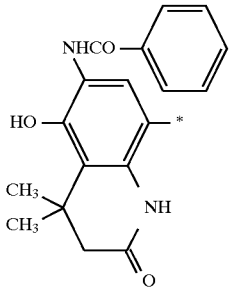
CP-16
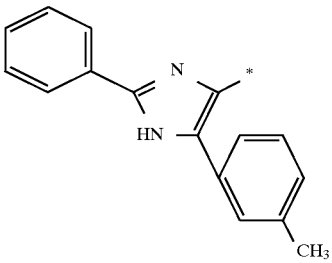
CP-17
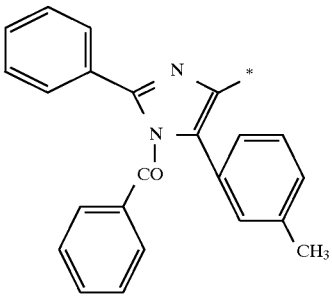

-continued
CP-18
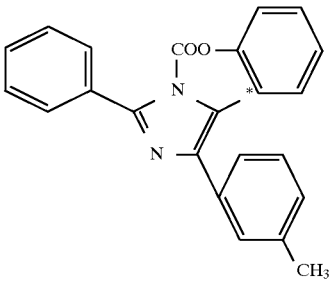
CP-19
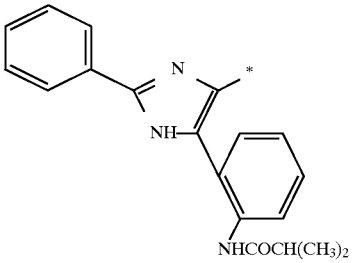
CP-20
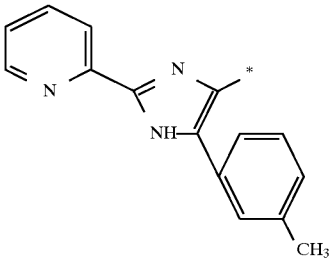
CP-21
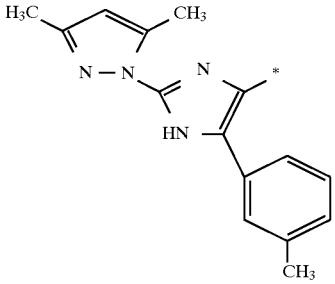
CP-22
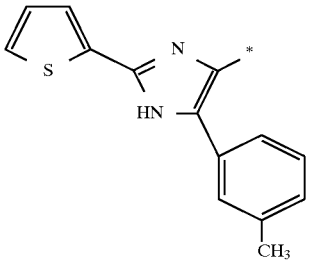

-continued
CP-23
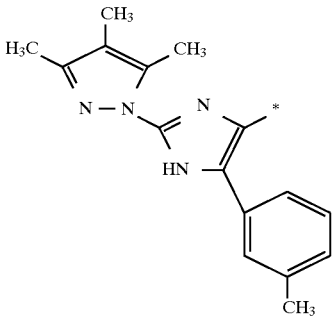
CP-24
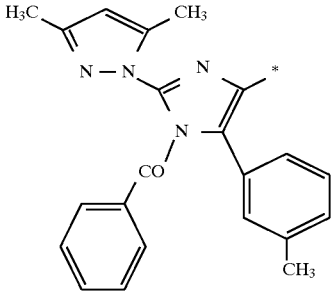
CP-25
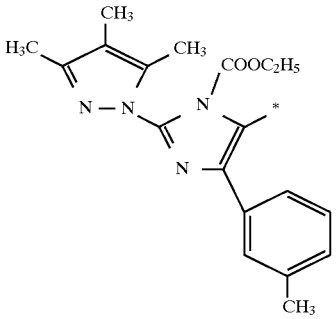
CP-26
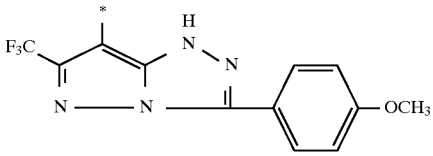
CP-27
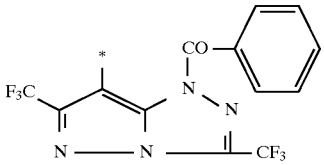
CP-28
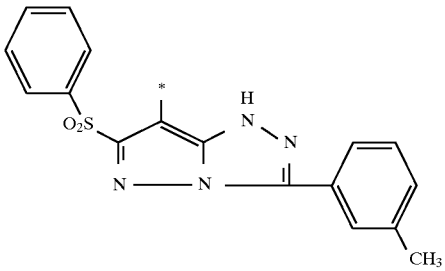

-continued
CP-29
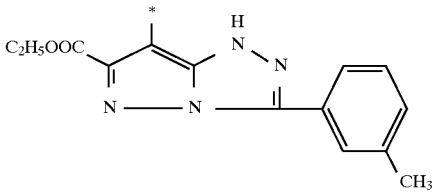
CP-30
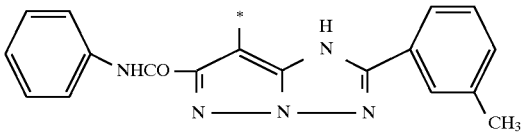
CP-31
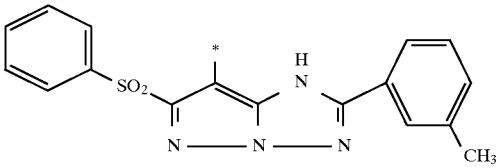
CP-32
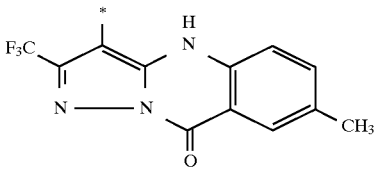
CP-33
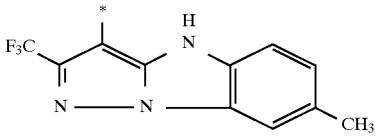
CP-34
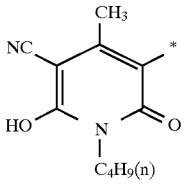
CP-35
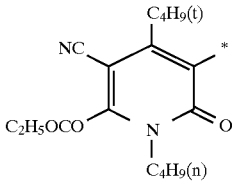
CP-36
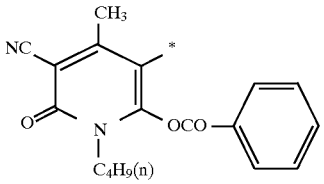
CP-37
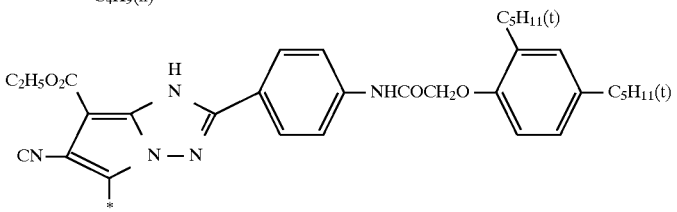

-continued
CP-38
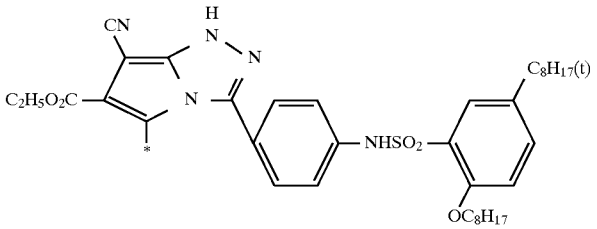
CP-39
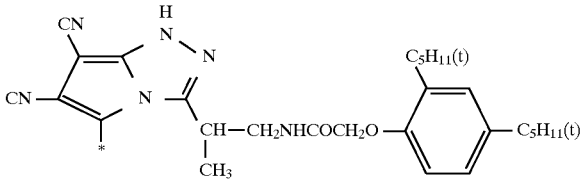
CP-40
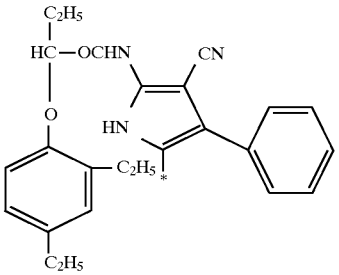
CP-41
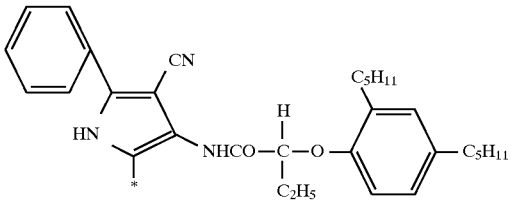
CP-42
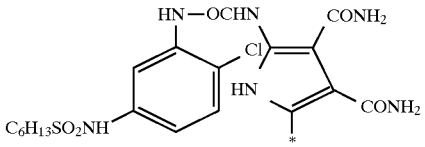
CP-43
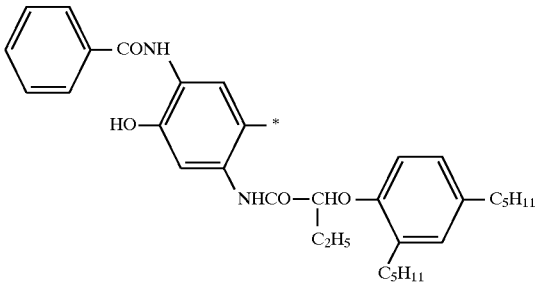
CP-44
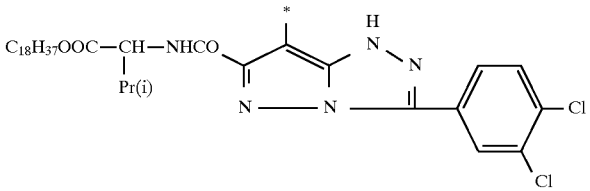

-continued
CD
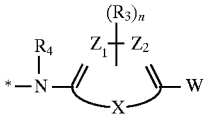
CD-1
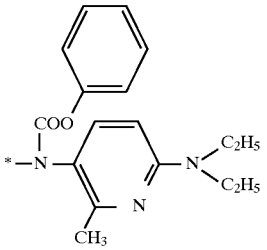
CD-2
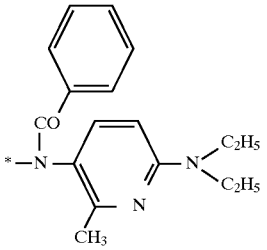
CD-3
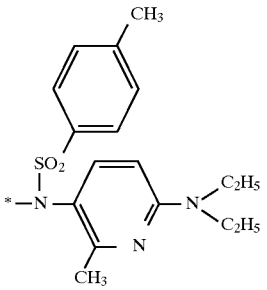
CD-4
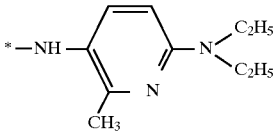
CD-5
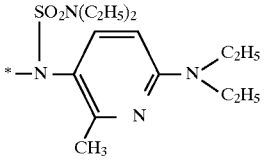
CD-6
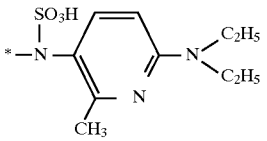
CD-7
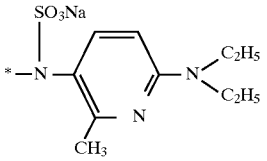

-continued
CD-8
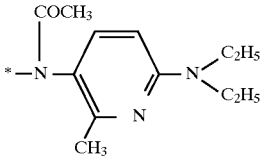
CD-9
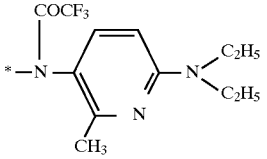
CD-10
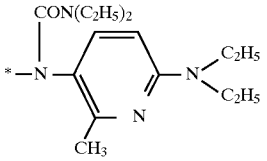
CD-11
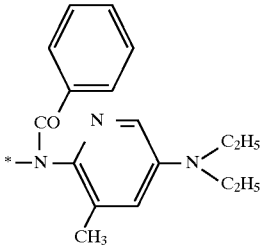
CD-12
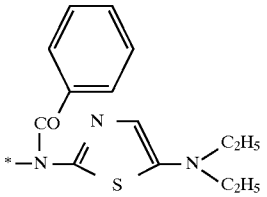
CD-13
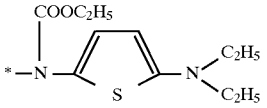
CD-14
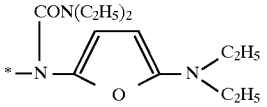
CD-15
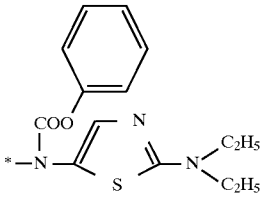
CD-16
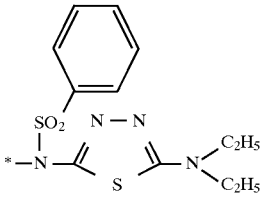

-continued
CD-17
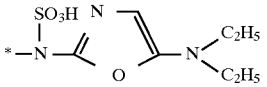
CD-18
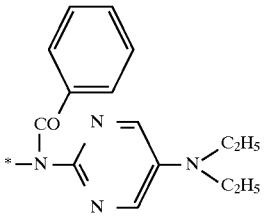
CD-19
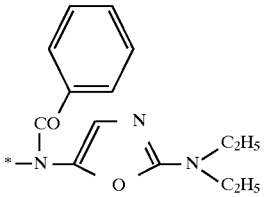
CD-20
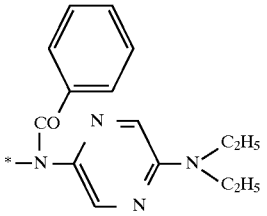
CD-21
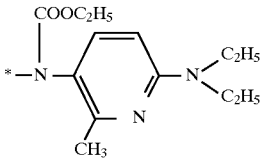
CD-22
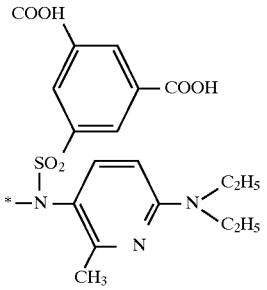
CD-23
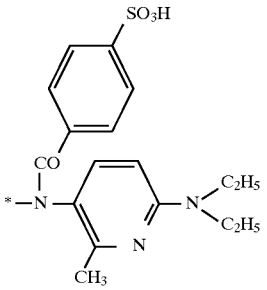
CD-24
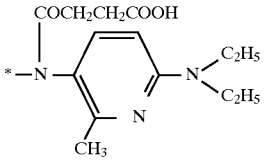

-continued
CD-25
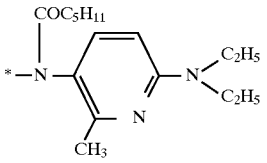
CD-26
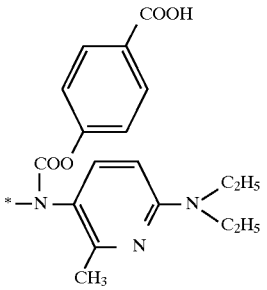
CD-27
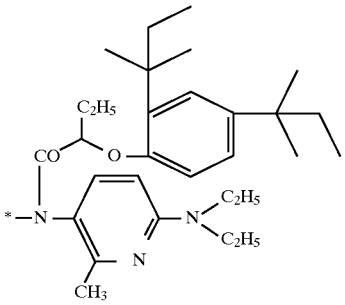
CD-28
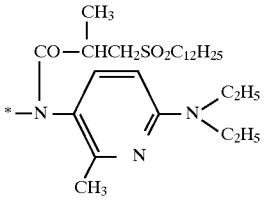
CD-29
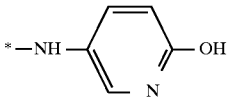
CD-30
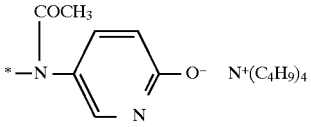
$RSO_3H$
a)
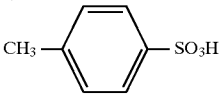
b)
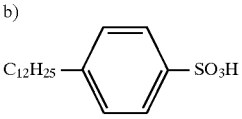
c)
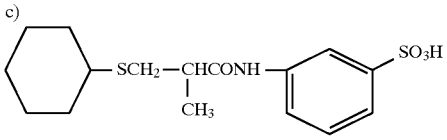

-continued d)

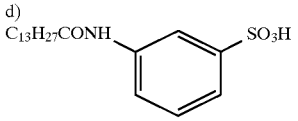

e)

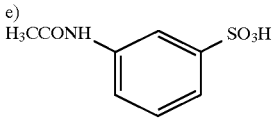

f)

$C_{12}H_{25}SO_3H$

SYNTHESIS EXAMPLE 1

(Synthesis of exemplified compound 8)

Reaction scheme

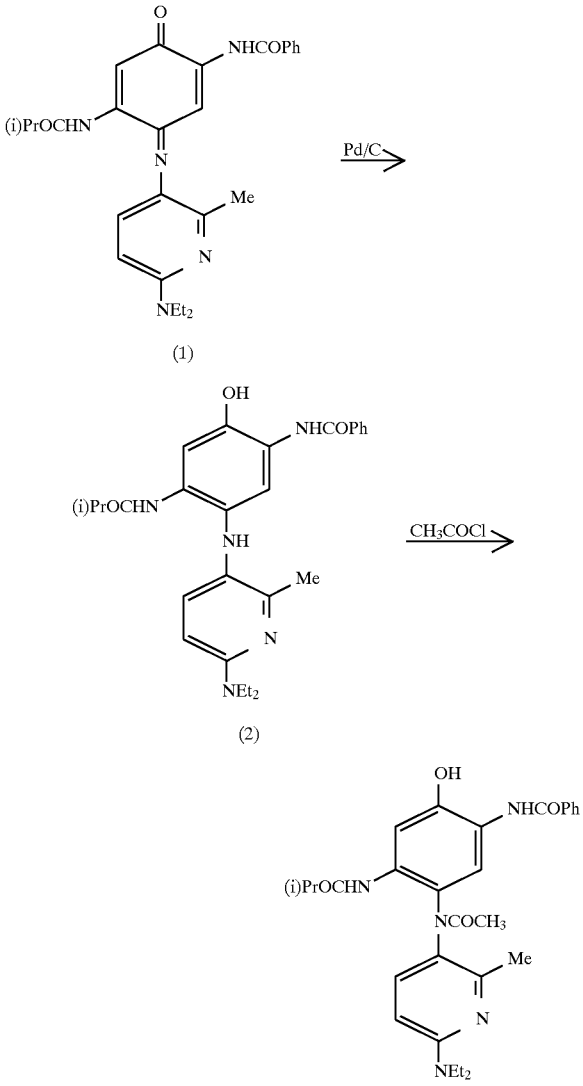

3.9 g of (1) was dissolved in 50 ml of ethyl acetate, 0.5 g of 5% Pd/C was added thereto and catalytic hydrogenation was carried out at ordinary presure. Blue color of the reaction mixture disappeared and (2) was produced.

Then, to the reaction mixture were added 1.2 g of triethylamine and 1.5 g of acetylchloride, and stirring was continued for 2 hrs. at room temperature. Catalyst and insoluble material were filtered out and the residue was dissolved in ethyl acetate and recrystalized to obtain exemplified compound 8 of 3.8 g (yield, 89%). The structure was confirmed by NMR spectrum and Mass spectrum.

SYNTHESIS EXAMPLE 2

(Synthesis of exemplified compound 9)

Reaction scheme

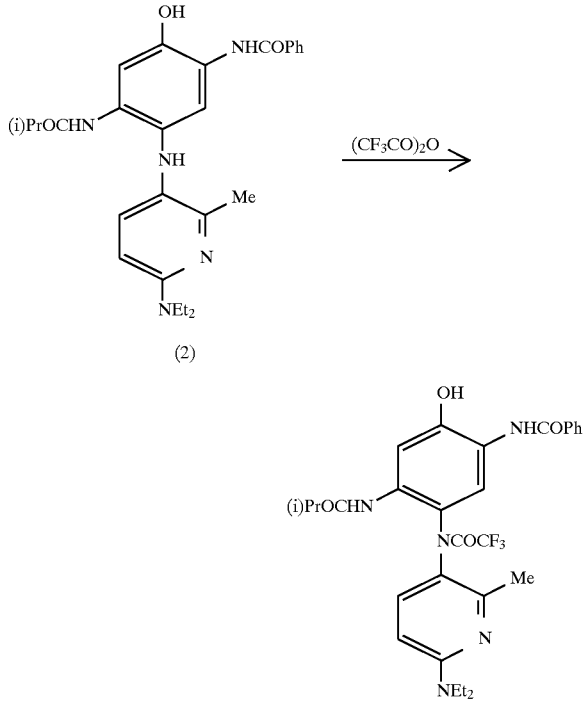

Exemplified compound 9

3.9 g of (1) of Example 1 was dissolved in 50 ml of ethyl acetate, 0.5 g of 5% Pd/C was added thereto and catalytic hydrogenation was carried out at ordinary pressure. Blue color of the reaction mixture disappeared and (2) was produced.

Then, to the reaction mixture were added 1.2 g of triethylamine and 4.0 g of trifluoroacetic acid anhydride, and stirring was continued for 2 hrs. at room temperature. Catalyst and insoluble material were filtered out and the residue was dissolved in ethyl acetate and recrystalized to obtain exemplified compound 9 of 4.0 g (yield, 85%). The structure was confirmed by NMR spectrum and Mass spectrum.

SYNTHESIS EXAMPLE 3

(Synthesis of exemplified compound 58)

Reaction scheme

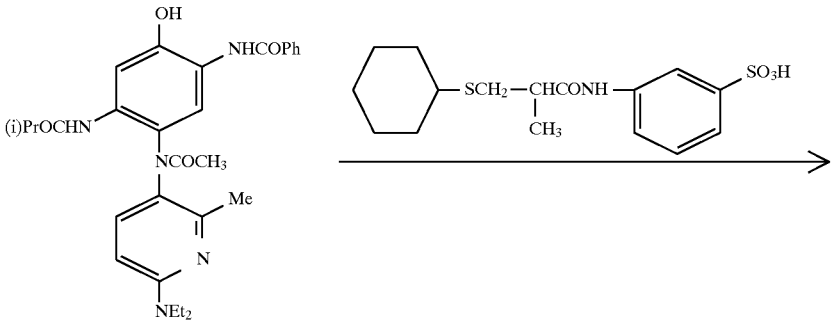

Exemplified compound 8

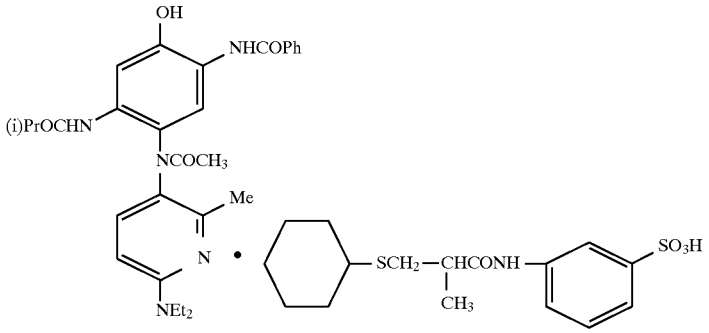

Exemplified compound 58

3.5 g of exemplified compound 8 was dissolved in 30 ml of methanol, 2.6 g of p-toluenesulfonic acid monohydrate was added thereto and stirring was further continued.

Then, the reaction mixture was poured into water of 300 ml and filtered out to obtain exemplified compound 58 of 4.1 g (yield, 87%). The structure was confirmed by NMR spectrum and Mass spectrum.

Compound other than the above were also be readily synthesized in a manner similar to the above synthesis examples.

The addition amount of the compound represented by formula (1) through (4), particularly in the case of medical photographic materials, is preferably not less than $1\times10^{-6}$ mol per mol of silver and not more than $5\times10^{-1}$ mol per mol of silver. In cases of being less than the lower limit, improvement of silver image tone is small and in cases of being not less than the upper limit, overall images appear to be unpreferably dark. The addition amount is more preferably not less than $5\times10^{-5}$ mol per mol of silver and less than $5\times10^{-2}$ and furthermore preferably, not less than $5\times10^{-4}$ mol per mol of silver and less than $1\times10^{-2}$ mol per mol of silver.

The compound represented by formula (1) through (4) can added in an optional manner, depending on propertied of the compound. For example, a method in which the compound is added in the form of a dispersion of solid fine particles, a method in which the compound is dissolved in a high boiling solvent and then dispersed in a manner similar to the above and a method in which the compound is dissolved in a water-miscible organic solvent (e.g., methanol, ethanol, acetone, etc.) and then added, are cited. Among these, addition in the form of a solid fine particle dispersion or through solution in the water-miscible organic solvent is preferred. In the case of being added in the form of a solid fine particle dispersion, conventional dispersing methods, such as acid precipitation method, ball mill, jet mill and impeller dispersion can be applied. The average size of dye fine particles may be optional, preferably 0.01 to 20 $\mu$m, and more preferably, 0.03 to 2 $\mu$m.

The molar ration of the compound represented by $RSO_3H$ to the compound represented by formula (3) or (4) is preferably 1 to 3.

The compound represented by formulas (1) through (4) of the invention may be incorporated in any of photographic component layers. In the case of X-ray photographic use, the compound is preferably incorporated in an emulsion layer or a layer between a support and the emulsion layer and more preferably, in a cross-over shielding layer.

The silver halide emulsion layer according to the invention contains a hydrophilic binder in an amount of not more than 3.0 g and preferably not more than 2.0 g per $m^2$ of one side, in cases where the emulsion layer is provided on both sides. In cases where emulsion layer is provided on one side alone, it is not more than 6.0 g and preferably 4.0 g/$m^2$.

The photographic light sensitive material of the invention is a black-and-white photographic material (photographic material for medical use, photographic material for printing, negative photographic material for general photographing use), color photographic material (color negative photographic material, color reversal photographic material, color photographic material for print), diffusion transfer type photographic material and heat-developable photographic material. Among these, the black-and-white photographic material is preferred and the photographic material for medical use is particularly preferred.

An emulsion layer or another component layer of the photographic material may contain a developing agent such as aminophenol, ascorbic acid, pyrocatechol, hydroquinone, phenylenediamine or 3-pyrazolidone.

The silver halide emulsion layer or a light insensitive hydrophilic colloidal layer preferably contain an organic or inorganic hardener. Chromium salts (e.g., chromium alum, chromium acetate), aldehydes (e.g., formaldehyde, glyoxal, glutar aldehyde), N-methylols (e.g., dimethylolurea, methyloldimethylhydantoin), dioxane derivatives (e.g., 2,3-dihydroxydioxane), active vinyl compound (e.g., 1,3,5-triacryloyl-hexahydro-s-triazine, bis-(vinylsulfonyl)methyl ether, N,N'-methylenebis-(β-(vinylsulfonyl) propioneamide), active halogen compounds (e.g., 2,4-dichloro-6-hydroxy-s-triazine), mucohalogenic acids (mucochloric acid, mucophenoxychloric acid), isooxazoles, and 2-chloro-6-hydroxytriazinyl gelatin are usable singly or in combination thereof. In particular, active vinyl compounds described in JP-A 53-41221, 53-57257, 59-162456, 60-80846 and active halogen compounds described in U.S. Pat. No. 3,325,287 are preferred.

Polymer hardeners are also usable. For example, dialdehyde starch; a polymer containing a aldehyde group such as polyacrolein or acrolein copolymer described in U.S. Pat. No. 3,396,029; a polymer containing a epoxy group described in U.S. Pat. No. 3,623,878; a polymer containing a dichlorotriazine group described in U.S. Pat. No. 3,362,827 and RD 17333 (1978); a polymer containing an active ester group described in JP-A 56-66841; and a polymer containing an active vinyl group or its precursor group described in JP-A 56-142524, 54-65033, U.S. Pat. No. 4,161,407 and RD 16725 (1978) are preferred. A polymer attached with an active vinyl group or its precursor group through a long spacer is particularly preferred.

It is preferred that the photographic material is previously hardened by adding thereto an optimal amount of a hardener in the process of coating so as to be suitable for rapid processing. Thereby, swell in the developing-fixing-washing process is adjusted and the amount of water contained in the photographic material prior to drying can be reduced.

The degree of swell of the photographic material of the invention in developing is preferably 150 to 250% and the layer thickness after being swollen is preferably not more than 70 μm. In the case when the degree of swell exceeds 250%, failure in drying occurs, resulting in, for example, tracking problems particularly when being rapidly processed by an automatic processor. In the case of the degree of swell being less than 150%, uneven developing and residual color tend to occur. The degree of swell is determined by dividing difference in layer thickness between before and after developing by layer thickness before developing and multiplying 100(%).

Supports usable in the photographic material of the invention include those described in RD 17643, page 28 and RD 308119, page 1009. A suitable support is plastic films. The surface of the support may be provided with a sublayer or subjected to corona discharge or UV irradiation so as to modify adhesibility.

A variety of adjuvants may be incorporated to the photographic material in accordance with its purpose. The adjuvants are described in RD 17643 (Dec., 1978), page 23, section III to page 28, section XVIII, ibid 18716 (Nov., 1979) pages 648–651, and ibid 308119 (Dec., 1989), page 996, section III to page 1009, section XVII.

Next, preferred processing of the photographic material will be described. The photographic material of the invention may be processed with processing solutions described in RD 17643, page 29, section XX to page 30, section XXI and RD 308119, page 1011, section XX to page 1012, section XXI.

In an automatic processor used in the invention which has mechanism of supplying a solid processing composition to a processing bath, known methods disclosed in Japanese Utility Model open to public inspection (OPI) publication 63-137783, 63-97522 and 1-85732 are available as a supplying means, in the case of the solid processing composition in a tablet form. If at least function for supplying the tablet to a processing bath is provided, any method may be usable. In the case of a solid processing composition in the form of granules or powder, gravity drop system described in Japanese Utility Model OPI publication 62-81964, 63-84151 and 1-292375, and screw-driving system described in Japanese Utility Model OPI publication 63-105159 and 63-195345 are known methods, but the present invention is not limited to these methods. The solid processing composition may be dropped in any portion of a processing bath. It is preferably the portion which is connected to a processing section and in which a processing solution flows to the processing portion. It is more preferably a structure in which a given amount of the processing solution circulates between the connected portion and the processing section and dissolved components are transferred to the processing section. The solid processing composition is preferably dropped into a temperature-controlled processing solution.

Dihydroxybenzenes described in JP-A 6-138591, aminophenols ,pyrazolidones and reductones described in JP-A 5-165161 are usable, as a developing agent, in a developer used in a processing method relating to the present invention. Among the pyrazolidones are preferred those substituted at the 4-position (Dimezone, Dimezone-S), which are water soluble and superior in storage stability when used in the form of the solid composition.

As preservatives are usable sulfites described in JP-A 6-138591 and organic reducing agents. Further, a chelating agent described in JP-A 6-258786 and a bisulfite adduct of a hardening agent may be used.

Anti-sludging agents described in JP-A 5-289255 and 6-308680 (Compounds represented by formulas 4-a and 4-b) may be added. Cyclodextrin compounds may be added, as described in JP-A 1-124853.

An amine compound may be added to a developing solution and compounds described in U.S. Pat. No. 4,269,929 are preferred.

The developing solution needs to contain a buffering agent. Examples of the buffering agent include sodium carbonate, potassium carbonate, sodium bicarbonate, potassium bicarbonate, trisodium phosphate, tripotassium phosphate, dipotassium phosphate, sodium borate, potassium borate, sodium tetraborate, potassium tetraborate, sodium o-hydroxybezoate, sodium o-hydroxybenzoate, sodium 5-sulfo-2-hydroxybenzoate and potassium o-hydroxybenzoate, sodium 5-sulfo-2-hydroxybenzoate.

As a development accelerating agent may be optionally added thioethers, p-phenylenediamine compounds, quaternary ammonium salts, p-aminophenols, amine compounds, polyalkyleneoxides, 1-phenyl-3-pyrrazolidones, hydrazines, mesoion type compounds, imidazoles.

Alkali halides such as potassium iodide and organic antifoggants are usable as an antifoggant. Examples of the organic antifoggants include nitrogen-containing heterocyclic compounds, such as benzotriazole, 6-nitrobenzimidazole, 5-nitroindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolidine, adenine and 1-phenyl-5-mercaptotetrazole.

Furthermore, methylcellosolve, methanol, acetone, dimethylformamide and cyclodextrin compounds may be optionally used in the developing solution, as a solvent for the purpose of enhancing solubility of the developing agent.

An anti-staining agent, anti-sludging agent and interlayer effect-promoting agent may be used.

Fixing agents usable in the invention are compounds known as a fixing agent. Besides the fixing agent, a chelating agent, pH-buffering agent, hardener, and preservative may be added into a fixing solution. In addition, a bisulfite adduct as a hardener and fixation-accelerating compound may be used.

It is preferred to add a starter prior to processing. A solidified starter is also preferred. An organic acid such as polycarboxylic acid compound, alkali earth metal halide, organic restrainer or development accelerator is used as a starter.

The photographic material of the invention is preferably processed within a total processing time of 10 to 45 sec and more preferably 15 to 30 sec. The expression, "total processing time within 45 sec." means completion of the process of developing to drying within 45 sec. In other words, a period of time from the time when a top of the photographic material is dipped into the developing solution, through processing steps, to the time when the top comes out from the drying zone (so-called Dry to Dry time) is 45 sec. or less.

Drying is conducted at a temperature 35 to 100, preferably 40° to 80° C. by blowing hot-air. A drying zone by a far-infrared heating means may be provided with the processor. There may be used an automatic processor in which a mechanism of providing water or acidic rinsing solution between a developing bath and a fixing bath or the fixing bath and a washing bath, as disclosed in JP-A 3-264953. A device for preparing a developer or fixer may be built therein. The photographic material may be processed with conventional processing solutions without use of solid processing composition, and the photographic material can be processed at a replenishing rate of a developer or fixer of not more than 200 ml per $m^2$ of the material.

Furthermore, various techniques employed in the art are applicable to embodiment of the invention.

EXAMPLES

The present invention will be explained based on examples, but embodiments of the invention is not limited thereto.

Example 1

Preparation of silver iodobromide hexagonal tabular grains

Preparation of Emulsion-1

| A1 | |
|---|---|
| Ossein gelatin | 75.5 g |
| Surfactant A* (10% ethanol solution) | 6.78 ml |
| Potassium bromide | 64.7 g |
| Water to make | 10800 ml |
| B1 | |
| 0.7 N Silver nitrate aqueous solution | 1340 ml |
| C1 | |
| 2.0 N Silver nitrate aqueous solution | 1500 ml |
| D1 | |
| 1.3 N Potassium bromide aqueous solution | 410 ml |
| E1 | |
| 2.0 N Potassium bromide aqueous solution in an amount necessary to maintain the pAg as below | |
| F1 | |
| Ossein gelatin | 125 g |
| Water | 4000 ml |

-continued

| A1 | |
|---|---|
| G1 | |
| KSCN aqueous solution (2N) | 60 ml |
| H1 | |
| Silver iodide fine grain emulsion containing 3% gelatin (average grain size 0.05 μm) | 0.008 mol |

*A: Sodium polypropyleneoxy-polyethleneoxy-disuccinate

The silver iodide fine grain emulsion (H1) was prepared in the following manner.

To 6.64 l of 5.0 wt. % gelatin aqueous solution containing 0.06 mol of potassium iodide were added 2.0 l of a solution containing 7.06 mol of silver nitrate and 2.0 l of a solution containing 7.06 mol of potassium iodide over a period of 10 min, while the pH and temperature were maintained at 2.0° and 40° C. After completing addition, the pH was adjusted to 6.0.

To solution A1 were added 400 ml of solution B1 and the total amount of solution D1 by the double jet precipitation method for a period of 40 sec. to form nucleus grains, with stirring at 55° C. by using a mixing stirrer as shown in examined and published Japanese Patents 58-58288 and 58-58289. After completing addition, solution F1 was added thereto and the temperature was raised to 70° C. and ripening was carried out. The remainder of solution B1 was further added for a period of 25 min., then 28% ammonium aqueous solution was added and ripening was further carried out for 10 min. After completing the ripening, the pH was adjusted with acetic acid so as to be neutral. Solutions C1 and E1 were simultaneously added at an accelerated flow rate, while being maintained at a pAg of 7.8. After adding solution C1, solutions G1 and H1 were added thereto. After being stirred for 5 min., the emulsion was desalted by the flocculation process to remove soluble salts. According to electron microscopic observation, it was proved that not less than 90% of the projected area of silver halide grains of the resulting emulsion was accounted for by hexagonal tabular grains having a maximum adjacent edge ratio of 1.0 to 2.0, the average thickness and average diameter (equivalent circle diameter of the hexagonal tabular grains being 0.20 μm and 0.80 μm, respectively. The width of grain size distribution was 15%.

Preparation of Emulsion-2

Emulsion-2 was prepared in the same manner as Emulsion-1, except that the addition amount of solution G1 was changed to 6 ml.

Preparation of Emulsion-3

Emulsion-3 was prepared in the same manner as Emulsion-1, except that solution G1 was not added.

Preparation of Emulsion-4

Emulsion-4 was prepared in the same manner as Emulsion-1, except that the addition amount of the silver iodide fine grain emulsion (H1) was changed to 0.16 mol equivalent and. Accordingly, the overall iodide content was 2.0 mol %.

Preparation of Emulsion-5

Emulsion-5 was prepared inthe same manner as Emulsion-1, except that, after adding solutions G1 and H1 and stirring for 5 min. and before desalting, the pAg was raised to 10.0 and the emulsion was stirred further for 5 min.

The resulting emulsions were summarized in Table 1.

In the Table, the expression, "added KSCN" and "SCN content" mean an addition amount of KSCN and an amount of $SCN^-$ contained in the final emulsion, respectively. The SCN content was determined by means of high pressure chromatography.

TABLE 1

| Emulsion No. | Iodide content (mol %) | KSCN added (mol/molAgx) | SCN content (mol/molAgX) | Remarks |
|---|---|---|---|---|
| 1 | 0.2 | 0.030 | 0.0028 | Inv. |
| 2 | 0.2 | 0.003 | 0.0002 | Inv. |
| 3 | 0.2 | 0.000 | 0.0000 | Comp. |
| 4 | 2.0 | 0.030 | 0.0029 | Comp. |
| 5 | 0.2 | 0.030 | 0.0002 | Inv. |

Subsequently, the emulsions were each kept at 47° C. and the following spectral sensitizing dyes (SD-1 and SD-2) were added thereto in the form of solid particle dispersion. Further, a mixture solution of ammonium thiocyanate, chloroauric acid and sodium thiosulfate, and a dispersion of triphenylphosphine selenide were added and ripening was carried out for 2 hr. and 30 min. After completing the ripening, stabilizer 4-hydroxy-6-methyl-1,3,3a,7-tetrazaindene (ST-1) was optimally added.

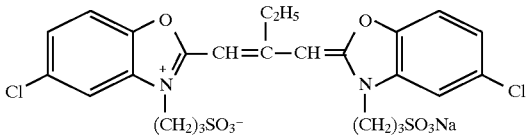

SD-1

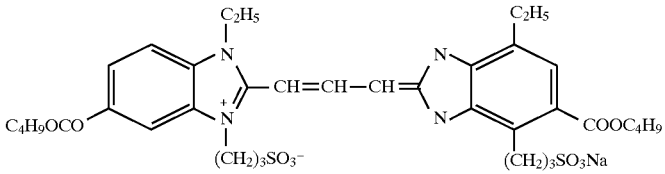

SD-2

The spectral sensitizing dyes and other additives were each added in an amount as below.

| | |
|---|---|
| SD-1 | 390 mg |
| SD-2 | 4 mg |
| Adenine | 10 mg |
| Sodium thiosulfate | 3.3 mg |
| Ammonium thiocyanate | 50 mg |
| Chloroauric acid | 2.0 mg |
| Silver iodide fine grain | 5 mmol equivalent |
| Triphenylphosphine selenide | 4.0 mg |
| ST-1 | 1000 mg |

In the above, "Silver iodide fine grain" is the same as the silver iodide fine grain emulsion (H1) containing 3% gelatin (average grain size 0.05 μm).

The solid particle dispersion of the sensitizing dyes were prepared according to the method described in Japanese Patent Application 4-99437. Thus, a given amount of the sensitizing dyes was added into water previously adjusted at 27° C. and stirred by means of a high-speed stirrer (dissolver) at 3,500 rpm for 30 to 120 min. to obtain the dispersion.

The above selenium sensitized dispersion was prepared as follows. Triphenylphosphine selenide of 120 g was dissolved in 30 kg of ethyl acetate at 50° C. Separately, photographic gelatin of 3.8 kg was dissolved in water of 38 kg and further thereto was added 93 g of sodium dodecylbenzenesulfonate 25 wt. % aqueous solution. Subsequently, these two solutions were mixed with each other and dispersed at 50° C. by a high-speed stirring type dispersing machine with a dissolver at a dispersing blade-speed of 49 m/sec. for a period of 30 min. After being dispersed, the dispersion was further stirred under reduced pressure to remove ethyl acetate until the residue of ethyl acetate reached 0.3 wt. %.

To the emulsion were added the following additives to prepare a coating solution of an emulsion layer. Coating solutions of a cross-over light shielding layer and protective layer were also prepared, as below.

As a support was employed a blue-tinted polyethylene terephthalate (PET) film base for use in radiography, with a density of 0.15 and a thickness of 175 μm and having thereon a layer mainly comprising glicidylmethaacrylate-methyl methaacrylate-butyl methaacrylate copolymer (50:10:40 wt. %) and a layer mainly comprised of cross-linked gelatin.

On both sides of the support, coating solutions of a cross-over light shielding layer, emulsion layer and protective layer were simultaneously coated in this order so as to have the following amount and dried to obtain radiographic use photographic material samples 1-1 to 1-21, provided that the coating amount was expressed as per 1 $m^2$ of one side of the photographic material.

First layer (Cross-over light shielding layer)

| | |
|---|---|
| Solid particle dispersion of dye (D-1) | 180 mg |
| Gelatin | 0.2 g |
| Sodium dodecylbenzenesulfonate | 5 mg |
| Compound (I) | 5 mg |
| Latex (L) | 0.2 g |
| Hardener (H-1) | 5 mg |
| Inventive or comparative compound, as shown in Table 2 | |
| Colloidal silica (av. size 0.014 μm) | 10 mg |
| Hardener (H-2) | 2 mg |

Second layer (Emulsion layer)

(The following additives were added to the emulsion above-described.)

| | |
|---|---|
| Compound (G) | 0.5 mg |
| Compound (T) | 5 mg |
| t-Butyl-catechol | 130 mg |
| Polyvinyl pyrrolidone (M.W. 10,000) | 35 mg |
| Styrene-anhydrous maleic acid copolymer | 80 mg |
| Sodium polystyrenesulfonate | 80 mg |
| Trimethylolpropane | 350 mg |
| Diethylene glycol | 50 mg |
| Nitrophenyl-triphenyl-phosphonium chloride | 20 $mg^2$ |
| Ammonium 1,3-dihydroxybenzene-4-sulfonate | 500 mg |
| Sodium 2-mercaptobenzimidazole-5-sulfonate | 5 mg |
| Compound (H) | 0.5 mg |
| $C_4H_9OCH_2CH(OH)CH_2N(CH_2COOH)_2$ | 350 mg |
| COMPOUND (M) | 5 mg |
| Compound (N) | 5 mg |
| Compound (R) | 2 mg |
| Colloidal silica | 0.5 g |
| Latex (L) | 0.2 g |

-continued

| | |
|---|---|
| Dextran (av. M.W. 1000) | 0.2 g |
| Compound (P) | 0.2 g |
| Inventive or Comparative compound as shown in Table 2 | |
| Compound (Q) | 0.2 g |

(Gelatin was coated so as to be 0.8 g/m$^2$, in total.)

Third layer (Protective layer-1 containing nonionic surfactant)

| | |
|---|---|
| Gelatin | 0.6 g |
| Matting agent of polymethyl methaacrylate (area-averaged particle size 7.0 $\mu$m) | 50 mg |
| Hardener (formaldehyde) | 20 mg |
| Hardener (H-1) | 10 mg |
| Bis-vinylsulfonylmethyl ether | 36 mg |
| Latex (L) | 0.2 g |
| Polyacrylamide (av. M.W. 10000) | 0.1 g |
| Polyacrylic acid sodium salt | 30 mg |
| Polysiloxane (SI) | 20 mg |
| Compound (I) | 12 mg |
| Compound (J) | 2 mg |
| Surfactant (B) | 7 mg |
| Compound (K) | 15 mg |
| Compound (O) | 50 mg |
| Surfactant (C) | 5 mg |
| $C_9F_{19}-O-(CH_2CH_2O)_{11}-H$ | 3 mg |
| $C_8F_{17}SO_2N(C_3H_7)-(CH_2CH_2O)_{15}H$ | 2 mg |
| $C_8F_{17}SO_2N(C_3H_7)-(CH_2CH_2O)_4-(CH_2)_4SO_3Na$ | 1 mg |
| Inventive or Comparative compound as shown in Table 2 | |
| Hardener (H-3) | 2 mg |

(Silver coverage was 1.5 g/m$^2$ of one side.)

H-1: 2,4-dichloro-6-hydroxy-s-triazine sodium salt

H-2: 1,3,5-triacryloyl-hexahydro-s-triazine

T: 2,6-bis(hydroxyamino)-4-diethylamino-1,3,5-triazine

J: ethyleneoxide 12 mol adduct of p-nonylphenol

B: i-amyl-decyl sulfosuccinic acid sodium salt

C: 2,2,3,3,4,4,5,5,6,6,7,7,-dodecylfluoroheptyl-acid sodium salt

D-1

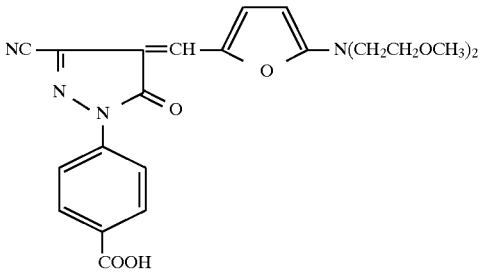

G

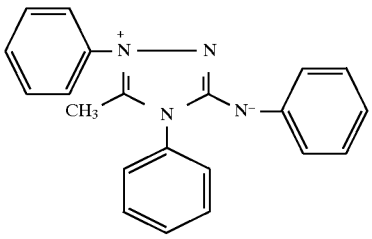

-continued

H

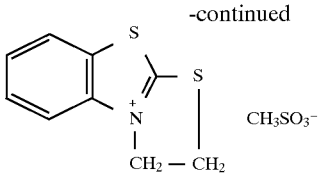

I

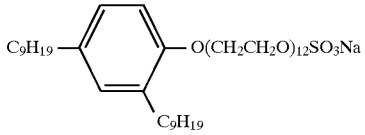

K

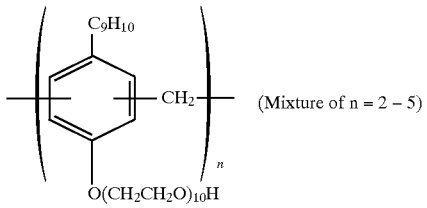

L

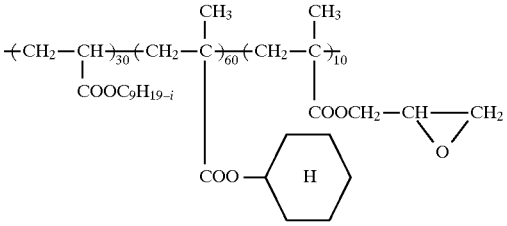

M

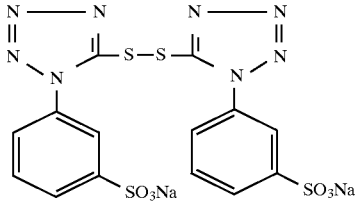

N

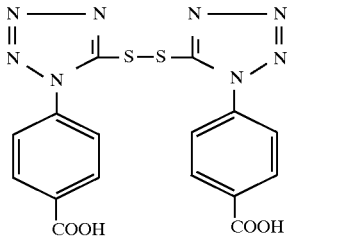

SI

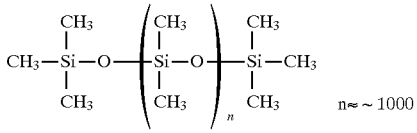

O $C_{11}H_{23}CONH(CH_2CH_2O)_5H$

P

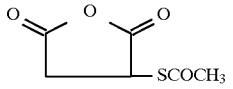

Q

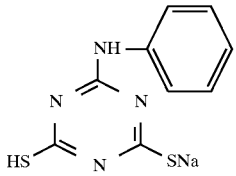

-continued

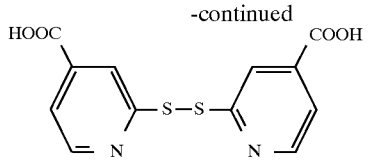

R

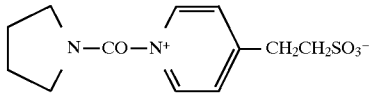

H-3

Constitution of each sample are summarized in Table 2.

TABLE 2

| Sample No. | Emulsion No | Light Shielding layer Compound (mol/mol Ag) | | Emulsion layer Compound (mol/mol Ag) | | Protective layer Compound (mol/mol Ag) | | Remarks |
|---|---|---|---|---|---|---|---|---|
| 1-1 | 1 | — | — | — | — | — | — | Comp. |
| 1-2 | 1 | Comp-1 | $2 \times 10^{-3}$ | — | — | — | — | Comp. |
| 1-3 | 1 | Comp-2 | $2 \times 10^{-3}$ | — | — | — | — | Comp. |
| 1-4 | 1 | Comp-3 | $2 \times 10^{-3}$ | — | — | — | — | Comp. |
| 1-5 | 2 | — | — | — | — | — | — | Comp. |
| 1-6 | 2 | Comp-1 | $2 \times 10^{-3}$ | | | — | — | Comp. |
| 1-7 | 3 | 8 | $2 \times 10^{-3}$ | — | — | — | — | Comp. |
| 1-8 | 3 | — | — | 8 | $2 \times 10^{-3}$ | — | — | Comp. |
| 1-9 | 3 | — | | — | — | 8 | $2 \times 10^{-3}$ | Comp. |
| 1-10 | 4 | 8 | $2 \times 10^{-3}$ | — | — | — | — | Comp. |
| 1-11 | 4 | — | — | 8 | $2 \times 10^{-3}$ | — | — | Comp. |
| 1-12 | 4 | — | — | — | — | 8 | $2 \times 10^{-3}$ | Comp. |
| 1-13 | 1 | 8 | $2 \times 10^{-3}$ | — | — | — | — | Inv. |
| 1-14 | 1 | — | — | 8 | $2 \times 10^{-3}$ | — | — | Inv. |
| 1-15 | 1 | — | — | — | — | 8 | $2 \times 10^{-3}$ | Inv. |
| 1-16 | 1 | 18 | $7 \times 10^{-4}$ | 18 | $7 \times 10^{-4}$ | — | — | Inv. |
| 1-17 | 1 | 38 | $1 \times 10^{-4}$ | — | — | — | — | Inv. |
| 1-18 | 1 | 51 | $1 \times 10^{-4}$ | — | — | — | — | Inv. |
| 1-19 | 2 | 8 | $2 \times 10^{-3}$ | — | — | — | — | Inv. |
| 1-20 | 2 | — | — | 8 | $2 \times 10^{-3}$ | — | — | Inv. |
| 1-21 | 2 | — | — | — | — | 8 | $2 \times 10^{-3}$ | Inv. |
| 1-22 | 1 | 57 | $3 \times 10^{-4}$ | — | — | — | — | Inv. |
| 1-23 | 1 | 65 | $2 \times 10^{-3}$ | — | — | — | — | Inv. |
| 1-24 | 1 | — | — | 76 | $2 \times 10^{-3}$ | — | — | Inv. |
| 1-25 | 1 | — | — | 77 | $2 \times 10^{-3}$ | — | — | Inv. |
| 1-26 | 5 | — | — | — | — | — | — | Comp. |
| 1-27 | 5 | Comp-1 | $2 \times 10^{-3}$ | — | — | — | — | Comp. |
| 1-28 | 5 | 8 | $2 \times 10^{-3}$ | — | — | — | — | Inv. |
| 1-29 | 5 | — | — | 8 | $2 \times 10^{-3}$ | — | — | Inv. |
| 1-30 | 5 | — | — | — | — | 8 | $2 \times 10^{-3}$ | Inv. |

Comp-1 (Comparative compound 1 described in JP-A 3-157645)

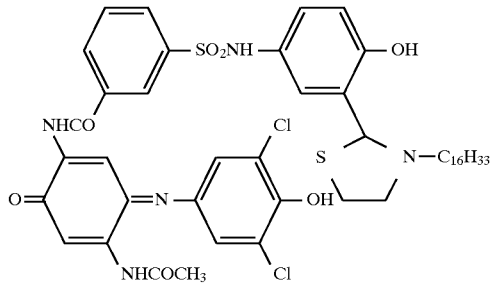

Comp-2 (Comparative compound 2 described in JP-A 3-532334)

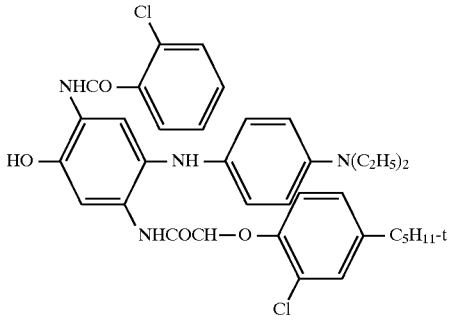

Comp-3 (Comparative compound 3 described in JP-A 3-165147)

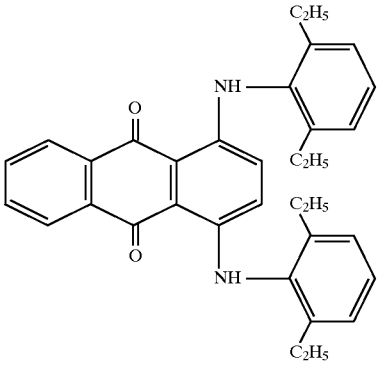

Each sample was sandwiched between fluorescent screens KO-250, exposed to X-ray through penetrometer type B (product by Konica medical Corp.) and processed for a total processing time of 25 sec. using the following processing solutions.

Solid developing compositions in the form of a tablet was prepared according to the following procedure.

Operation (A)

13000 g of sodium erythorbic acid, as a developing agent was ground into grain until an average grain size became 10 μm using a commercially available bandom mill. 4877 g of sodium sulfite, 975 g of Phenidone and 1635 g of DTPA (diethylenetriaminepentaacetic acid, pentasodium salt) were added to this powder and mixed by the mill for 30 min. After granulating the mixture by adding 30 ml of water at room temperature for 10 min., the granulated product was dried for 2 hr. using a fluidized bed dryer at 40° C. to remove moisture contained almost completely. The thus prepared granules was mixed with 2167 g of polyethylene glycol 6000 using a mixer for 10 min. in a room conditioned at 25° C. and 40% R.H. Thereafter, the mixture was subjected to compression-molding on a modified tabletting machine, Tough Press Collect 1527 HU, produced by Kikusui Manufacturing Co., Ltd. to prepare 2500 tablets (A) having a weight of 8.715 g per tablet, for use as a developing-replenisher.

Operation (B)

19500 g of potassium carbonate, 8.15 g of 1-phenyl-5-mercaptoterazole, 3.25 g of sodium hydrogencarbonate, 650 g of glutar aldehyde sulfite adduct and 1354 g of polyethylene glycol #6000 were ground to form granules in a similar manner to the operation (A). After granulation, the granules were dried at 50° C. for 30 min. to almost completely remove moisture contained. Thereafter, the mixture was subjected to compression-molding on a modified tabletting machine, Tough Press Collect 1527 HU, produced by Kikusui Manufacturing Co., Ltd. to prepare 2500 tablets (B) having a weight of 9.90 g per tablet, for use as a developing-replenisher.

Solid fixing compositions in the form of a tablet were prepared according to the following procedure.

Operation (C)

18560 g of ammonium thiosulfate, 1392 g of sodium thiosulfate 580 g of sodium hydroxide and 2.32 g of sodium ethylenediaminetetraacetate were ground and mixed in a similar manner to Operation (A). Adding water of 500 ml, the mixture was granulated in a similar manner to the operation (A). After granulation, the granules were dried at 60° C. for 30 min. to almost completely remove moisture contained. Thereafter, the mixture was subjected to compression-molding on a modified tabletting machine, Tough Press Collect 1527 HU, produced by Kikusui Manufacturing Co., Ltd. to prepare 2500 tablets (C) having a weight of 8.214 g per tablet, for use as a fixing-replenisher.

Operation (D)

1860 g of boric acid, 6500 g of aluminum sulfate 18 hydrate, 1860 g of glacial acetic acid and 928 g of sulfuric acid (50 wt. %) were ground and mixed in a similar manner to the above operation (A). Adding water of 100 ml, the mixture was granulated in a similar manner to the operation (A). After granulation, the granules were dried at 50° C. for 30 min. to almost completely remove moisture contained. Thereafter, the mixture was subjected to compression-molding on a modified tabletting machine, Tough Press Collect 1527 HU, produced by Kikusui Manufacturing Co., Ltd. to prepare 1250 tablets (D) having a weight of 4.459 g per tablet, for use as fixing-replenisher.

Starter for developer

| | |
|---|---|
| Glacial acetic acid | 2.98 g |
| KBr | 4.0 g |
| Water to make | 1 liter |

At the time of starting processing (running process), tablets of developing compositions (A) and (B) were dissolved in water to make 16.5 liters of developing solution. To the developing solution, 330 ml of afore-described starter was added to make a developer-starting solution. The pH of the developer-starting solution was 10.45.

Photographic material samples were exposed so as to give a density of 1.0 and subjected to running-processing. Processing was carried out using an automatic processor, SRX-502, which was provided with a input member of a solid processing composition and modified so as to complete processing within 25 sec.

During running-processing, one tablet (A) and two tablet (B) per $m^2$ of the photographic material were added to the developing solution, with 20 ml of water. When the tablets (A) and (B) were dissolver in Water, its pH was 10.70.

To the fixing solution, t tablets (C) and two tablets (D) were added with 50 ml of water. Addition of water was started at the same time of that of the tablets and continued at a constant rate further for 10 min. in proportion to a dissolving rate of the solid processing composition.

Processing condition

| | |
|---|---|
| Developing: 35° C. | 8.2 sec. |
| Fixing: 33° C. | 5.0 sec. |
| Washing: Ordinary temp. | 4.5 sec. |
| Squeegee: | 1.6 sec. |
| Drying: 40° C. | 5.7 sec. |
| Total | 25.0 sec. |

Compositions of processing solutions used were as follows.

Composition of developing solution (per liter of water)

| | |
|---|---|
| Potassium carbonate | 120.0 g |
| Sodium erythorbate | 40.0 g |
| DTPA | 5.0 g |
| 1-Phenyl-5-mercaptotetrazole | 0.05 g |
| Sodium hydrogencarbonate | 20.0 g |
| 1-Phenyl-3-pyrazolidone | 3.0 g |
| Sodium sulfite | 15.0 g |
| Polyethylene glycol | 15.0 g |
| Glutar aldehyde sulfite adduct | 4.0 g |

Composition of fixing solution (per liter of water)

| | |
|---|---|
| Ammonium thiosulfate | 160.0 g |
| Sodium sulfite | 12.0 g |
| Boric acid | 10.0 g |
| Sodium hydroxide | 5.0 g |
| Glacial acetic acid | 10.0 g |
| Aluminum sulfate octadacahydrate | 35.0 g |
| Sulfuric acid (50 wt. %) | 5.0 g |
| Disodium ethylenediaminetetraacetate dihydrate | 0.02 g |

Processed samples were evaluated with respect to sensitivity, storage stability, smudge of a fluorescent screen, silver image tone, and fog.

Sensitivity

The sensitivity was shown as a relative value of reciprocal of the X-ray exposure amount necessary for obtaining a density of a minimum density plus 1.0, based on the sensitivity of Sample 1 being 100.

As a measure of storage stability, samples were allowed to stand for 4 hrs. at 23° C. and 48% R.H., then, packaged in moisture-resistance package and further allowed to stand for 4 days at 55° C.; thereafter, samples were exposed in the same manner as above and evaluated with respect to the sensitivity after storage.

Smudge of fluorescent screen

Samples each were rubbed with a fluorescent screen (intensifying screen) 500 times and evaluated, by visually observing the surface thereof, with respect to staining of the screen.

Silver image tone

Silver image tone was evaluated by visually observing image color of a portion with a density of 1.5 of the processed photographic material sample. In Table 3, Y.Bl: Yellowish black image tone R.Bl: Reddish black image tone G.Bl: Greenish black image tone N.Bl: Neutral black image tone D.B: Dark blue image tone Fog After processed samples were allowed to stand for 4 hrs. at 23° C. and 48% R.H. and then packaged in moisture-resistance package and further allowed to stand for 4 days at 55° C., the density of the samples was measured and difference in density from Sample 1 was compared as a measure of storage stability of processed photographic materials.

Results thereof are shown in Table 3.

TABLE 3

| Sample No. | Sensitivity ($S_1$)* | After storage $S_2$ | Smudge | Image tone | Fog | Remarks |
|---|---|---|---|---|---|---|
| 1-1 | 100 | 75 | not obs.** | Y · Bl | 0.000 | Comp. |
| 1-2 | 51 | 40 | obs. | R · Bl | 0.005 | Comp. |
| 1-3 | 82 | 69 | not obs. | G · Bl | 0.010 | Comp. |
| 1-4 | 67 | 55 | obs. | N · Bl | 0.009 | Comp. |
| 1-5 | 90 | 60 | not obs. | Y · Bl | 0.005 | Comp. |
| 1-6 | 40 | 35 | obs. | R · Bl | 0.010 | Comp. |
| 1-7 | 50 | 45 | not obs. | Y · Bl | 0.000 | Comp. |
| 1-8 | 44 | 30 | not obs. | Y · Bl | 0.001 | Comp. |
| 1-9 | 52 | 48 | not obs. | Y · Bl | 0.000 | Comp. |
| 1-10 | 70 | 65 | not obs. | Y · Bl | 0.000 | Comp. |
| 1-11 | 67 | 64 | not obs. | Y · Bl | 0.000 | Comp. |
| 1-12 | 69 | 62 | not obs. | Y · Bl | 0.002 | Comp. |
| 1-13 | 101 | 95 | not obs. | N · Bl | 0.000 | Inv. |
| 1-14 | 101 | 94 | not obs. | N · Bl | 0.000 | Inv. |
| 1-15 | 92 | 87 | not obs. | N · Bl | 0.001 | Inv. |
| 1-16 | 105 | 93 | not obs. | N · Bl | 0.001 | Inv. |
| 1-17 | 104 | 94 | not obs. | D · B | 0.002 | Inv. |
| 1-18 | 106 | 92 | not obs. | D · B | 0.002 | Inv. |
| 1-19 | 96 | 90 | not obs. | N · Bl | 0.000 | Inv. |
| 1-20 | 88 | 83 | not obs. | N · Bl | 0.002 | Inv. |
| 1-21 | 92 | 85 | not obs. | N · Bl | 0.001 | Inv. |
| 1-22 | 93 | 91 | not obs. | D · B | 0.001 | Inv. |
| 1-23 | 88 | 84 | not obs. | D · B | 0.000 | Inv. |
| 1-24 | 95 | 93 | not obs. | D · B | 0.001 | Inv. |
| 1-25 | 94 | 91 | not obs. | D · B | 0.000 | Inv. |
| 1-26 | 93 | 85 | not obs. | Y · Bl | 0.005 | Comp. |
| 1-27 | 55 | 48 | obs. | R · Bl | 0.010 | Comp. |
| 1-28 | 99 | 99 | not obs. | N · Bl | 0.000 | Inv. |
| 1-29 | 95 | 94 | not obs. | N · Bl | 0.001 | Inv. |
| 1-30 | 97 | 94 | not obs. | N · B1 | 0.000 | Inv. |

*$S_1$: Sensitivity before storage
$S_2$: Sensitivity after storage
**not obs.: not observed
obs.: observed As can be seen from Table 3, inventive samples were shown to be a silver halide photographic material little in variation of sensitivity after pre-exposure storage and transfer to the screen as smudge, rapid-processable, superior in silver image tone, low in fog density after-processing storage and little in variation of photographic performance.

Example 2

Preparation of silver iodochloride grain emulsion

Preparation of Emulsion-6

| A5 | |
|---|---|
| Ossein gelatin | 75.0 g |
| Potassium iodide | 1.25 g |
| Sodium chloride | 33.0 g |
| Distilled water to make | 15000 ml |
| B5 | |
| Silver nitrate | 410 g |
| Distilled water to make | 684 ml |
| C5 | |
| Silver nitrate | 11590 g |
| Distilled water to make | 19316 ml |
| D5 | |
| Potassium iodide | 4 g |
| Sodium chloride | 140 g |
| Distilled water to make | 684 ml |
| E5 | |
| Sodium chloride | 3980 g |
| Distilled water to make | 19274 ml |

To solution A5 kept at 40° C. with stirring by a mixing stirrer as described in examined Japanese Patents 58-58288 and 58-58289 were added solution B5 and solution D5 for 1 min. The EAg was adjusted to 149 mV and Ostwald ripening was further conducted for 20 min. Thereafter, solution C5 and solution E5 were added for 320 min, while the EAg was kept at 149 mV. After completing the addition, the emulsion was desalted to obtain an Emulsion-5. Based on electron microscopic observation, it was proved that the resulting Emulsion-5 was comprised of tabular grains having (100) major faces and according for 65% of the total grain projected area, which have a average grain thickness of 0.14 μm, average grain diameter of 1.0 and a variation coefficient of grain size of 25%.

Preparation of Emulsion-7

Emulsion-7 was prepared in the same manner as Emulsion-6, except that $8\times10^{-6}$ mol of potassium hexachloroiridlum was contained in solution E5.

Subsequently, the emulsions were chemically sensitized.

To Emulsions-6 and 7 maintained at 55° C. were added a given amounts of sensitizing dyes (SD-3 and SD-4) in the form of a solid particle dispersion. Then, a sulfur sensitizer, selenium sensitizer, gold sensitizer and a compound (R) were added and ripening was carried out over a period of 90 min. After completing the ripening, a stabilizer (ST-1) was added in an optimal amount, and an emulsion coating solutions were prepared by adding the adjuvants as those of Example 1, except for inventive and comparative compounds.

Compounds added in the ripening process

| | |
|---|---|
| Silver iodide fine grain emulsion | 5 mmol equivalent |
| SD-3 | 280 mg |
| SD-4 | 40 mg |
| Sulfur sensitizer | 20 mg |
| Gold sensitizer | 1.0 mg |
| Selenium sensitizer (triphenylphosphineselenide) | 4.0 mg |
| Compound (R) | 5.0 mg |
| ST-1 | 50 mg |

SD-3

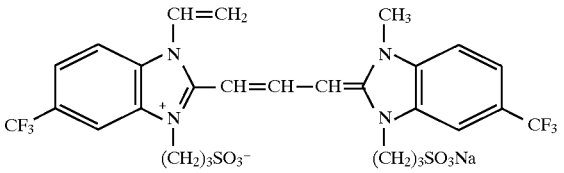

-continued

SD-4

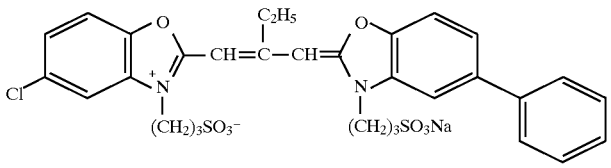

Sulfur sensitizer

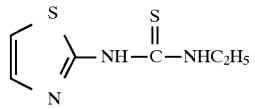

Gold sensitizer

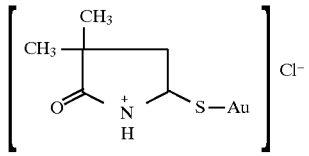

Furthermore, coating solutions of a cross-over light shielding layer and a protective layer were prepared in the same manner as in Example 1, except that inventive and comparative compounds were varied. The resulting coating solutions were coated on both sides of the support and dried to prepare photographic material samples, as shown in Table 4.

TABLE 4

| Sample No. | Emulsion No | Light Shielding layer Compound (mol/mol Ag) | | Emulsion layer Compound (mol/mol Ag) | | Protective layer Compound (mol/mol Ag) | | Remarks |
|---|---|---|---|---|---|---|---|---|
| 2-1 | 7 | — | — | — | — | — | — | Comp. |
| 2-2 | 7 | Comp-1 | $4\times10^{-3}$ | — | — | — | — | Comp. |
| 2-3 | 7 | Comp-2 | $4\times10^{-3}$ | — | — | — | — | Comp. |
| 2-4 | 7 | Comp-3 | $4\times10^{-3}$ | — | — | — | — | Comp. |
| 2-5 | 6 | 9 | $4\times10^{-3}$ | | | — | — | Comp. |
| 2-6 | 6 | — | — | 9 | $4\times10^{-3}$ | — | — | Comp. |
| 2-7 | 6 | — | — | — | — | 9 | $4\times10^{-3}$ | Comp. |
| 2-8 | 7 | 9 | $4\times10^{-3}$ | | | — | — | Inv. |
| 2-9 | 7 | — | — | 9 | $4\times10^{-3}$ | — | — | Inv. |
| 2-10 | 7 | — | — | — | — | 9 | $4\times10^{-3}$ | Inv. |
| 2-11 | 7 | 18 | $1\times10^{-3}$ | 18 | $1\times10^{-3}$ | — | — | Inv. |
| 2-12 | 7 | 30 | $5\times10^{-4}$ | — | — | — | — | Inv. |
| 2-13 | 7 | 42 | $2\times10^{-4}$ | — | — | — | — | Inv. |
| 2-14 | 7 | 58 | $4\times10^{-3}$ | — | — | — | — | Inv. |
| 2-15 | 7 | 60 | $5\times10^{-4}$ | — | — | — | — | Inv. |
| 2-16 | 7 | — | — | 70 | $2\times10^{-3}$ | — | — | Inv. |
| 2-17 | 7 | — | — | 76 | $2\times10^{-3}$ | — | — | Inv. |

Each of the samples was subjected to exposure and processing, and evaluated in the same manner as in Example 1. Results thereof are summarized in Table 5.

TABLE 5

| Sample No. | Sensitivity ($S_1$)* | After storage $S_2$ | Smudge | Image tone | Fog | Remarks |
|---|---|---|---|---|---|---|
| 2-1 | 100 | 80 | not obs.** | Y · Bl | 0.000 | Comp. |
| 2-2 | 97 | 70 | obs. | R · Bl | 0.005 | Comp. |
| 2-3 | 90 | 69 | not obs. | G · Bl | 0.010 | Comp. |
| 2-4 | 85 | 55 | obs. | N · Bl | 0.009 | Comp. |
| 2-5 | 50 | 45 | not obs. | Y · Bl | 0.000 | Comp. |
| 2-6 | 44 | 33 | not obs. | Y · Bl | 0.001 | Comp. |
| 2-7 | 52 | 48 | not obs. | Y · Bl | 0.000 | Comp. |
| 2-8 | 101 | 95 | not obs. | N · Bl | 0.000 | Inv. |
| 2-9 | 102 | 92 | not obs. | N · Bl | 0.000 | Inv. |
| 2-10 | 101 | 94 | not obs. | N · Bl | 0.000 | Inv. |
| 2-11 | 105 | 93 | not obs. | N · Bl | 0.001 | Inv. |
| 2-12 | 104 | 94 | not obs. | N · Bl | 0.002 | Inv. |
| 2-13 | 106 | 92 | not obs. | D · B | 0.002 | Inv. |
| 2-14 | 89 | 86 | not obs. | D · B | 0.001 | Inv. |
| 2-15 | 90 | 88 | not obs. | D · B | 0.001 | Inv. |
| 2-16 | 88 | 87 | not obs. | D · B | 0.001 | Inv. |
| 2-17 | 91 | 90 | not obs. | D · B | 0.000 | Inv. |

*$S_1$: Sensitivity before storage
$S_2$: Sensitivity after storage
**not obs.: not observed
obs.: observed As can be seen from the Table, even when a high chloride containing silver halide grain emulsion was used, inventive samples were shown to be a silver halide photographic material superior in silver image tone, little in transfer to the screen as smudge, low in fog density after-processing storage and little in variation of photographic performance.

What is claimed:

1. A silver halide photographic light sensitive material comprising a support having thereon a silver halide emulsion layer, wherein said silver halide emulsion layer comprises tabular silver halide grains having an average iodide content of 1.0 mol % or less; said silver halide emulsion layer further comprising a compound represented by the following formula (1):

Formula (1)

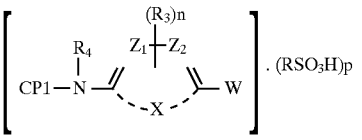

wherein W is —$NR_1R_2$, —OH or —OZ, in which $R_1$ and $R_2$ each are an alkyl group or an aryl group and Z is an alkali metal ion or a quaternary ammonium ion; $R_3$ is a hydrogen atom, a halogen atom or a univalent substituent and n is an integer of 1 to 3; $Z_1$ and $Z_2$ each are a nitrogen atom or =C($R_3$)—; X is an atomic group necessary for forming a 5 or 6-membered aromatic heterocyclic ring; $R_4$ is a hydrogen atom, an acyl group, a sulfonyl group, a carbamoyl group, a sulfo group, a sulfamoyl group, an alkoxycarbonyl group, or aryoxycarbonyl group; R is an aliphatic group or an aromatic group; p is 0, 1 or 2; CP1 is a group selected from the following formulas:

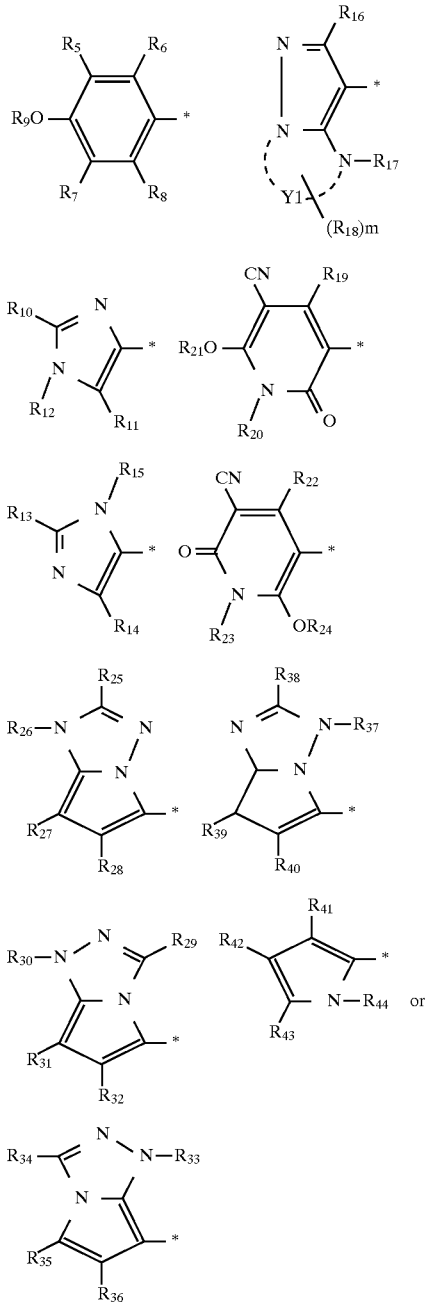

wherein $R_5$ through $R_8$ independently are a hydrogen atom, a halogen atom or a substituent, provided that $R_5$ and $R_6$, or $R_7$ and $R_8$ are optionally linked with each other to form a 5 to 7-membered ring; $R_9$ has the same definition as $R_4$; $R_{10}$ and $R_{11}$ independently are an alkyl group, an aryl group or a heterocyclic group; $R_{12}$ has the same definition as $R_4$; $R_{13}$ and $R_{14}$ each have the same definition of $R_{10}$ and $R_{11}$; $R_{15}$ has the same definition as $R_{12}$; $R_{16}$ is an alkyl group, an aryl group, a sulfonyl group, a trifluoromethyl group, a carboxy group, an aryloxycarbonyl group, an alkoxycarbonyl group, a carbamoyl group or a cyano group; $R_{17}$ has the same definition as $R_4$; $R_{18}$ has the same definition as $R_3$; m is an integer of 1 to 3; Y1 is an atomic group necessary for forming 5 or 6-membered nitrogen containing ring; $R_{19}$ and $R_{20}$ independently are an alkyl group or an aryl group; $R_{21}$ has the same definition as $R_4$; $R_{22}$ and $R_{23}$ each have the same definition as $R_{19}$ and $R_{20}$; $R_{24}$ has the same definition as $R_{21}$; $R_{25}$, $R_{27}$ and $R_{28}$ independently are a hydrogen atom or a substituent; $R_{26}$ has the same definition as $R_4$; $R_{29}$, $R_{31}$ and $R_{32}$ each have the same definition as $R_{25}$, $R_{27}$ and $R_{28}$; $R_{30}$ has the same definition as $R_{26}$; $R_{34}$, $R_{35}$ and $R_{36}$ each have the same definition $R_{25}$, $R_{27}$ and $R_{28}$; $R_{33}$ has the same definition as $R_{26}$; $R_{38}$, $R_{39}$ and $R_{40}$ each have the same definition as $R_{25}$, $R_{27}$ and $R_{28}$; $R_{37}$ has the same definition as $R_{26}$; $R_{41}$, $R_{42}$ and $R_{43}$ each have the same definition as $R_{25}$, $R_{27}$ and $R_{28}$; $R_{44}$ has the same definition as $R_{26}$; the symbol, "★" represents a bonding site of CP1with the other moiety.

2. The silver halide photographic material of claim 1, wherein said compound represented by formula (1) is represented by formula (2):

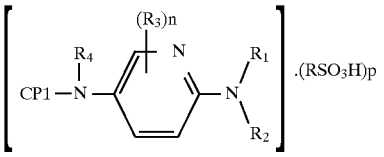

Formula (2)

wherein $R_1$, $R_2$, $R_3$ and $R_4$, CP1, n, R and p each have respectively the same definitions as those of $R_1$, $R_2$, $R_3$ and $R_4$, CP1, n, R and p of formula (1).

3. The silver halide photographic material of claim 1, wherein at least one of $R_4$ $R_9$, $R_{12}$, $R_{15}$, $R_{17}$, $R_{21}$, $R_{24}$, $R_{26}$, $R_{30}$, $R_{33}$, $R_{37}$ and $R_{44}$ is substituted by a substituent selected from the group consisting of —$COOM^1$ and —$SO_3M^2$, in which $M^1$ and $M^2$ are each a hydrogen atom or an alkali metal atom.

4. The silver halide photographic material of claim 1, wherein said compound represented by formula (1) is contained in an amount of $1\times10^{-6}$ to $5\times10^{-1}$ mol per mol of silver.

5. The silver halide photographic material of claim 1, wherein said tabular grains have an aspect ratio of 2 to 20 and account for at least 50% of the total grain projected area of said silver halide emulsion layer, said tabular grains having been formed in the presence of a silver halide solvent.

6. The silver halide photographic material of claim 5, wherein said silver halide solvent is selected from the group consisting of thioethers, thioureas, compounds having a thiocarbonyl group adjoined to an oxygen or sulfur atom and a nitrogen atom, imidazoles, sulfites and thiocyanates.

7. The silver halide photographic material of claim 6, wherein said silver halide solvent is selected from the group consisting of thioethers, thioureas, imidazoles, sulfites and thiocyanates.

8. The silver halide photographic material of claim 7, wherein said silver halide solvent is a thiocyanate or tetramethylthiourea.

9. The silver halide photographic material of claim 5, wherein said tabular grains are prepared by a process comprising (i) forming silver halide grains by adding a silver salt and a halide salt into a reaction vessel containing a dispersion medium, (ii) subjecting the silver halide grains to desalting to remove soluble salts and (iii) subjecting the silver halide grains to chemical ripening, wherein said silver halide solvent is added at a time during course of forming the silver halide grains in the step of (i).

10. The silver halide photographic material of claim 9, wherein in the step of (i), iodide is added in the form of a silver iodide fine grain emulsion.

11. The silver halide photographic material of claim 10, wherein said silver iodide fine grain emulsion is added after completion of adding a silver salt and halide salt.

12. The silver halide photographic material of claim 1, wherein said tabular grains have an aspect ratio of 1.3 or more and account for at least 50% of the total grain projected area of said silver halide emulsion layer, said tabular grains having (100) major faces and a chloride content of 20 mol % or more and containing a metal ion selected from the group consisting of iron, iridium, platinum, palladium, nickel, rhodium, osmium, ruthenium, cobalt, cadmium, zinc, mercury, lead, molybdenum, tungsten and chromium.

* * * * *